US008158316B2

(12) United States Patent
Iwanaga et al.

(10) Patent No.: US 8,158,316 B2
(45) Date of Patent: Apr. 17, 2012

(54) ELECTROPHOTOGRAPHIC PHOTORECEPTOR, PROCESS CARTRIDGE AND IMAGE FORMING APPARATUS

(75) Inventors: Takeshi Iwanaga, Kanagawa (JP); Shigeru Yagi, Kanagawa (JP); Nobuyuki Torigoe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 888 days.

(21) Appl. No.: 12/145,282

(22) Filed: Jun. 24, 2008

(65) Prior Publication Data

US 2009/0092916 A1 Apr. 9, 2009

(30) Foreign Application Priority Data

Oct. 3, 2007 (JP) ..... 2007-259541

(51) Int. Cl.

| | |
|---|---|
| ***G03G 15/04*** | (2006.01) |
| ***G03G 21/16*** | (2006.01) |
| ***G03G 15/00*** | (2006.01) |
| ***G03G 5/14*** | (2006.01) |

(52) U.S. Cl. ..... 430/66; 399/111; 399/159

(58) Field of Classification Search ..... 430/66; 399/111, 159

See application file for complete search history.

(56) References Cited

U.S. PATENT DOCUMENTS

| | | | | |
|---|---|---|---|---|
| 4,848,141 | A | 7/1989 | Oliver et al. | |
| 2002/0115012 | A1* | 8/2002 | Hashizume et al. | 430/126 |
| 2003/0054271 | A1 | 3/2003 | Yao et al. | |
| 2008/0070138 | A1* | 3/2008 | Yagi et al. | 430/66 |

FOREIGN PATENT DOCUMENTS

| | | |
|---|---|---|
| JP | A-58-080647 | 5/1983 |
| JP | A-62-174770 | 7/1987 |
| JP | A-05-035156 | 2/1993 |
| JP | A-09-101625 | 4/1997 |
| JP | A-2002-318459 | 10/2002 |
| JP | A-2003-027238 | 1/2003 |
| JP | A-2006-267507 | 10/2006 |
| JP | A-2007-57862 | 3/2007 |

OTHER PUBLICATIONS

Machine Translation of JP 2006-267507 A, with a publication date of Oct. 5, 2006.*

Machine Translation of JP 2007-057862 A, with a publication date of Mar. 8, 2007.*

Japanese Office Action issued on Oct. 27, 2009 in Japanese Patent Application No. 2007-259541 (with translation).

* cited by examiner

*Primary Examiner* — Christopher Rodee

*Assistant Examiner* — Jonathan Jelsma

(74) *Attorney, Agent, or Firm* — Oliff & Berridge, PLC

(57) ABSTRACT

An electrophotographic photoreceptor includes an electrically conductive substrate, an organic photosensitive layer and a surface layer laminated in this order. The surface layer includes at least gallium (Ga) and oxygen (O) as constituent elements thereof, and has a thickness of 0.2 μm to 1.5 μm, and a microhardness of 2 GPa to 15 GPa.

12 Claims, 6 Drawing Sheets

ELECTROPHOTOGRAPHIC PHOTORECEPTOR, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2007-259541 filed Oct. 3, 2007.

BACKGROUND

1. Technical Field

The present invention relates to an electrophotographic photoreceptor, a process cartridge and an image forming apparatus.

2. Related Art

In recent years, electrophotography is widely used for image forming apparatuses such as copying machines and printers. An electrophotographic photoreceptor (which may also be referred to hereinafter as a "photoreceptor") used in image forming apparatuses utilizing electrophotography as described above is exposed to various contact and stress within the apparatuses, thereby resulting in deterioration. On the other hand, the electrophotographic photoreceptor is required to have high reliability in association with digitalization and colorization of image forming apparatuses.

For example, when attention is paid to the charging process of a photoreceptor, the following problems emerge. First, in a non-contact charging mode, discharge products adhere to the photoreceptor, and thus image blurring and the like occur. Accordingly, in order to remove the discharge products that adhere to the photoreceptor, for example, a system has been be employed in which a developer is mixed with particles having an abrasive function, and the discharge products are rubbed off in a cleaning section. However, in this case, the surface of the photoreceptor is deteriorated by abrasion.

SUMMARY

According to an aspect of the invention, there is provided an electrophotographic photoreceptor including an electrically conductive substrate, an organic photosensitive layer and a surface layer laminated in this order, the surface layer including at least gallium (Ga) and oxygen (O) as constituent elements thereof and having a thickness of 0.2 μm to 1.5 μm, and a microhardness of 2 GPa to 15 GPa.

BRIEF DESCRIPTION OF THE DRAWINGS

Exemplary embodiments of the present invention will be described in detail based on the following figures, wherein.

DETAILED DESCRIPTION

Hereinafter, the present invention will be described in detail.

Electrophotographic Photoreceptor

The electrophotographic photoreceptor according to the present exemplary embodiment is constructed by laminating an electrically conductive substrate, an organic photosensitive layer and a surface layer in this order, the surface layer including at least gallium (Ga) and oxygen (O) as constituent elements thereof, and having a thickness of 0.2 μm to 1.5 μm, and a microhardness of 2 GPa to 15 GPa.

In the electrophotographic photoreceptor according to the present exemplary embodiment, since the thickness and microhardness of the surface layer having a specific composition are adjusted to appropriate ranges, uneven wear at the surface layer and mechanical damages (for example, cracks or depressions) due to repeated use are prevented, thereby the initial surface characteristics being maintained. As a result, image defects are prevented.

Hereinafter, the electrophotographic photoreceptor according to exemplary embodiments will be described with reference to the drawings.

Figure 1:
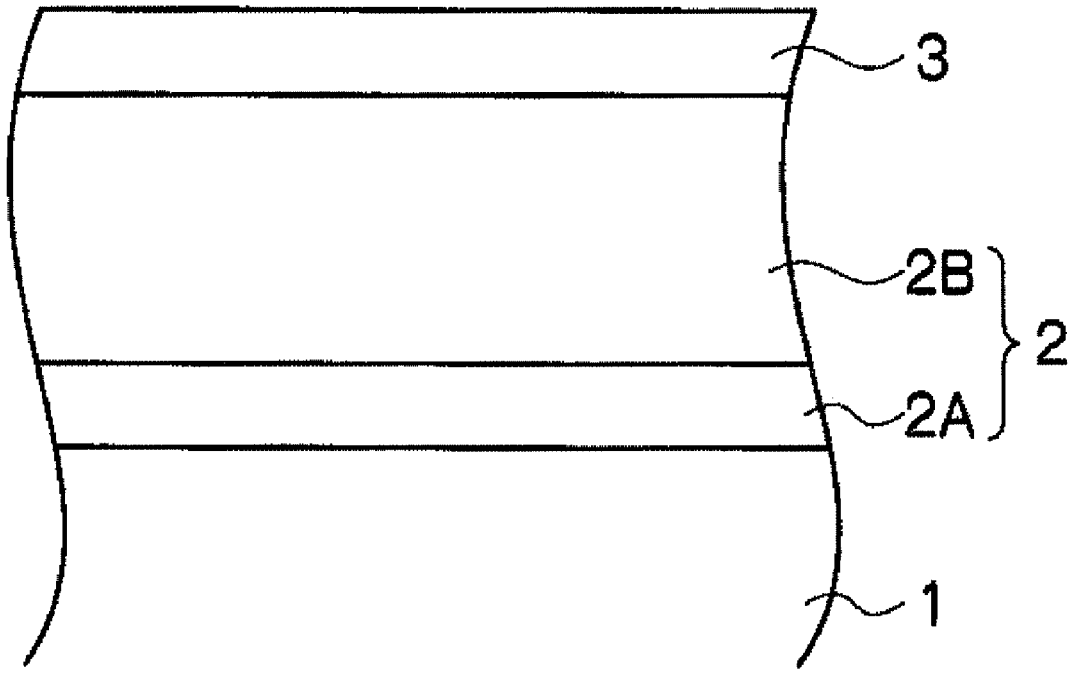
FIG. 1 is a schematic cross-sectional view showing an exemplary layer configuration of an electrophotographic photoreceptor according to the present exemplary embodiment.

FIG. 1 is a schematic cross-sectional view showing an exemplary layer configuration of a photoreceptor according to the present exemplary embodiment. In FIG. 1, reference numeral 1 denotes an electrically conductive substrate, 2 denotes an organic photosensitive layer, 2A denotes a charge generating layer, 2B denotes a charge transport layer, and 3 denotes a surface layer. The photoreceptor shown in FIG. 1 has a layer configuration in which a charge generating layer 2A, a charge transport layer 2B and a surface layer 3 are laminated in this order on a conductive substrate 1, and the organic photosensitive layer 2 is composed of two layers of the charge generating layer 2A and the charge transport layer 2B.

Figure 2:
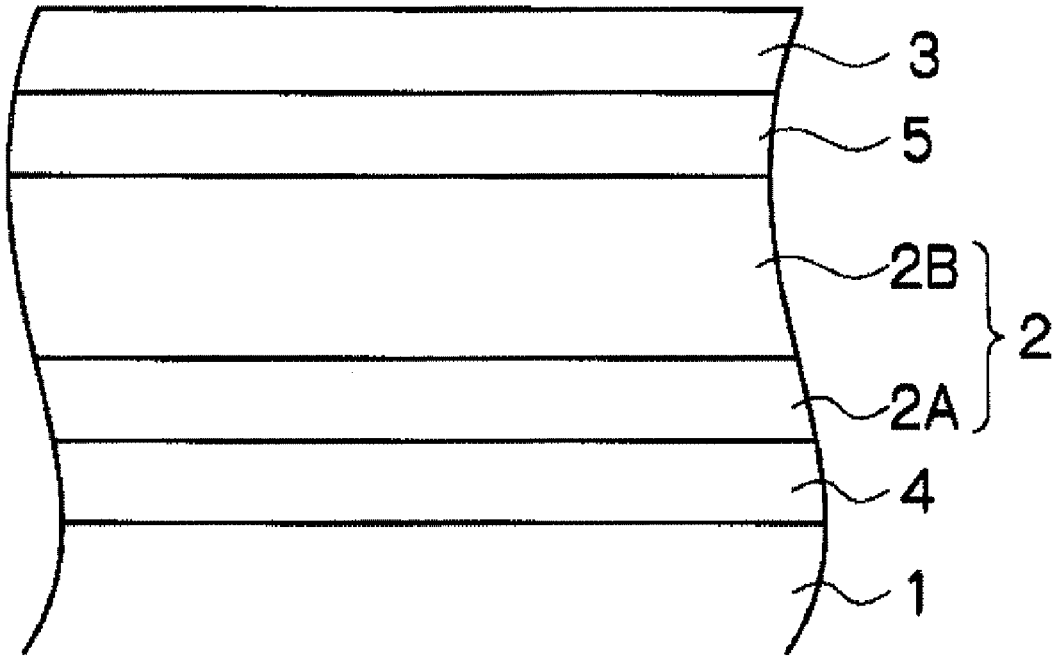
FIG. 2 is a schematic cross-sectional view showing another exemplary layer configuration of an electrophotographic photoreceptor according to the present exemplary embodiment.

FIG. 2 is a schematic cross-sectional view showing another exemplary layer configuration of a photoreceptor according to the present exemplary embodiment. In FIG. 2, reference numeral 4 denotes an undercoat layer, and reference numeral 5 denotes an intermediate layer, while the others are the same as defined in FIG. 1. The photoreceptor shown in FIG. 2 has a layer configuration in which an undercoat layer 4, a charge generating layer 2A, a charge transport layer 2B, an intermediate layer 5 and a surface layer 3 are laminated in this order on a conductive substrate 1.

Figure 3:
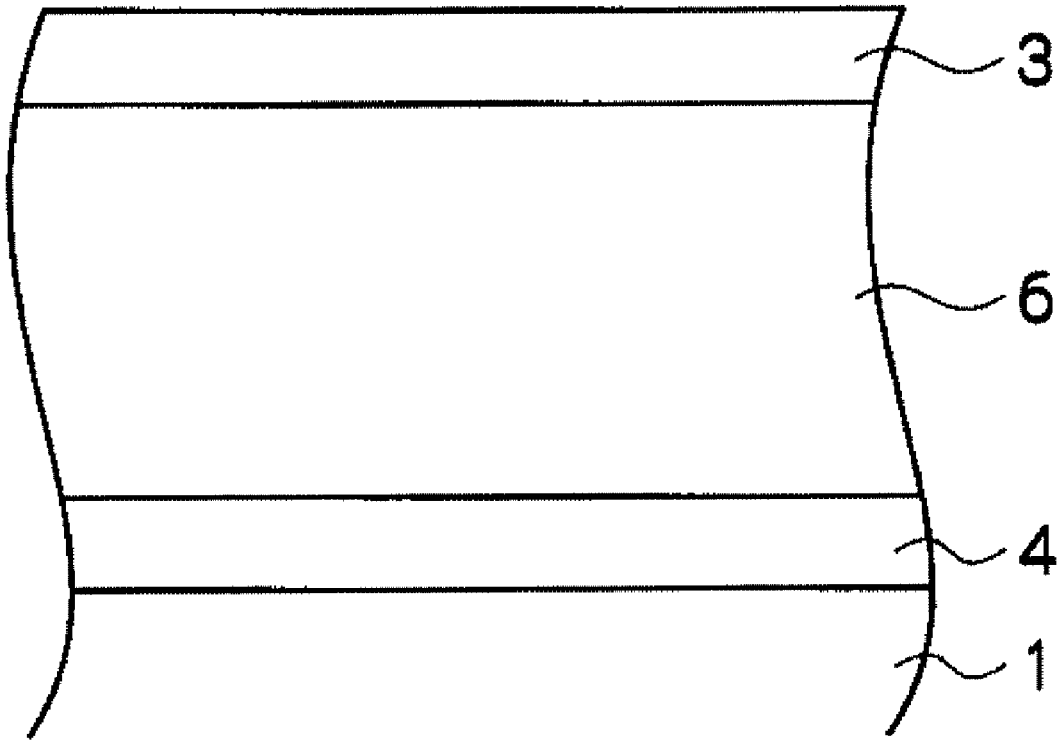
FIG. 3 is a schematic cross-sectional view showing another exemplary layer configuration of an electrophotographic photoreceptor according to the present exemplary embodiment.

FIG. 3 is a schematic cross-sectional view showing another exemplary layer configuration of a photoreceptor according to the present exemplary embodiment. In FIG. 3, reference numeral 6 denotes an organic photosensitive layer, while the others are the same as defined in FIG. 1 and FIG. 2. The photoreceptor shown in FIG. 3 has a layer configuration in which an organic photosensitive layer 6 and a surface layer 3 are laminated in this order on a conductive substrate 1, and the organic photosensitive layer 6 is a layer in which the functions of the charge generating layer 2A and the charge transport layer 2B shown in FIG. 1 or FIG. 2 are integrated.

First, the surface layer will be described in detail. The surface layer is a layer containing at least gallium (Ga) and oxygen (O) as constituent elements. The surface layer has a thickness of 0.2 μm to 1.5 μm, and a microhardness of 2 GPa to 15 GPa.

The surface layer has a thickness of 0.2 μm to 1.5 μm, but the thickness may also be 0.2 μm to 0.7 μm.

If the layer thickness of the surface layer is smaller than 0.2 μm, even though the microhardness of the surface layer is within the above-described range, the mechanical strength of the layer is insufficient, and there occur mechanical damages due to repeated use. As a result, for example, image deletion occurs.

On the other hand, if the layer thickness of the surface layer is larger than 1.5 μm, there occur mechanical damages due to repeated use, which are attributable to the shear force exerted by the members in contact with the photoreceptor. As a result, for example, a decrease in the halftone density of an image obtained immediately after the start of process after subjecting the photoreceptor to repeated use under high temperature and high humidity (for example, in an environment at 28° C. and 85% RH) and overnight standing, may be recovered with many difficulties.

The surface layer has a microhardness of 2 GPa to 15 GPa, but the microhardness may also be 4 GPa to 10 GPa.

If the microhardness of the surface layer is lower than 2 GPa, hardness of the layer itself is insufficient, and thus there occurs uneven wear which is dependent on the amount of development. As a result, for example, under the effect of interference resulting from a large difference in the refractive index between the surface layer and the underneath organic photosensitive layer, fluctuation occurs in the amount of light incident on the organic photosensitive layer, and thereby irregularities in the halftone density are generated.

On the other hand, if the microhardness of the surface layer is greater than 15 GPa, the layer becomes brittle, and there occur mechanical damages due to repeated use. As a result, for example, a decrease in the halftone density of an image obtained immediately after the start of process after subjecting the photoreceptor to repeated use under high temperature and high humidity (for example, in an environment at 28° C. and 85% RH) and overnight standing, may be recovered with many difficulties.

Here, for the microhardness, the hardness value obtained at an indentation depth in the range of 30 nm to 40 nm is used. The value may be a hardness value at the indentation depth as described above, for which a depth profile has been determined by a continuous stiffness measurement method (U.S. Pat. No. 4,848,141), or may be a hardness value determined from a loading-unloading curve obtained with a load in the above-described range. As for the measurement apparatus, a nano-indenter (trade name: NANO INDENTER DCM, manufactured by MTS Systems, Corp.) is used. As for the indenter, a regular triangular pyramid indenter made of diamond (Berkovich indenter) is used.

In the surface layer, the sum of the respective elemental composition ratios of gallium and oxygen to all the elements constituting the surface layer may be 0.7 or more, and the elemental composition ratio of oxygen to gallium (oxygen/gallium) may be from 1.1 to 1.5. Thereby, it becomes easier to secure the hardness of the surface layer, and thus mechanical damages due to repeated use are further prevented.

In the surface layer, the sum of the respective elemental composition ratios of gallium and oxygen to all the elements constituting the surface layer may be 0.70 or more, and the sum of the respective elemental composition ratios of gallium (Ga), oxygen (O) and hydrogen (H) to all the elements constituting the surface layer may be 0.95 or more. The elemental composition ratio of oxygen to gallium (oxygen/gallium) may be 1.1 to 1.4. Thereby, the hardness of the surface layer may be secured, and at the same time, the control range of electrical resistance may be increased. Thus, it may become easier to secure appropriate electrical conductivity, while mechanical damages (for example, cracks or depressions) due to repeated use and generation of excess residual potential may be prevented, thereby a balance between durability and electrical properties being achieved.

On the other hand, if the elemental composition ratio of oxygen to gallium (oxygen/gallium) is lower than 1.1, it may be difficult to secure the hardness of the layer, and the effect of preventing mechanical damages may be reduced. Furthermore, there are cases where the electrical resistance value is excessively lowered, and electrostatic latent image deletion occurs in the surface direction, thus a sufficient resolution of images not being obtained. Materials having the elemental composition ratio exceeding 1.5 may not be obtained in a stable state as a material containing gallium, oxygen and hydrogen as constituent elements thereof. Materials having the elemental composition ratio exceeding 1.4 may have problems in the residual potential because of high electrical resistance. Therefore, this elemental composition ratio of oxygen to gallium (oxygen/gallium) may be 1.1 to 1.4.

The surface layer may also contain hydrogen. Since gallium oxide containing hydrogen has a broader control range of the electrical resistance, it becomes easy to secure appropriate electrical conductivity. As for a gallium oxide film containing hydrogen, it is conceived that since hydrogen binds to gallium, the electrons of the oxygen deficient gallium are electrically deactivated, thus exerting an impact on the electrical properties. It is also conceived that when hydrogen is contained in the membrane, flexibility of binding increases. Although it is thought that the relationship between the composition of gallium oxide containing hydrogen and the electrical properties differs from that of gallium oxide not containing hydrogen, the reason why the former improves the controllability of electrical resistance more effectively is not clear.

The content of hydrogen contained in the surface layer may be 1 atomic % to 30 atomic % or, or may be 5 atomic % to 20 atomic %. If the content of hydrogen is less than 1 atomic %, the effect of electrically deactivating the electrons of the oxygen deficient gallium may be insufficient. If the content of hydrogen exceeds 30 atomic %, cases where two or more hydrogen atoms bind to gallium may be increased, whereby a three-dimensional structure may not be maintained, and the hardness and chemical stability, particularly water resistance and the like, may become insufficient.

In the case where hydrogen is contained as an element constituting the surface layer, the sum of the respective elemental composition ratios of gallium, oxygen and hydrogen to all the elements constituting the surface layer may be 0.95 or more, and more specifically, may be 0.99 or more. If this sum of the elemental composition ratios is less than 0.95, for example, in the case where Group 15 elements such as N, P and As, or the like are incorporated, the influence exerted by binding of these elements to gallium, or the like, cannot be neglected, and thus an appropriate range of the elemental composition ratio of oxygen to gallium (oxygen/gallium), which improves the hardness and electrical properties of the surface layer, may not be found.

The surface layer may contain elements other than oxygen, gallium and hydrogen, as impurities. However, since large amounts of impurities may exert impact on the hardness or electrical properties, it is more favorable to have impurities in an amount as small as possible. Specifically, the impurities may be present in an amount of 5 atomic % or less, or 1 atomic % or less. Particularly, in the case of containing nitrogen atoms, the content of nitrogen atoms may be 1 atomic % or less.

Here, the elemental composition of the surface layer represents the values averaged in the direction of the layer thickness of the surface layer, excluding a region extending from the outermost surface to 10 nm in depth. The reason for excluding the region extending from the outermost surface to 10 nm in depth is to eliminate any influence of carbon or the like due to contamination and to eliminate the influence of natural oxidation. Incidentally, even if an insulating film at a stoichiometric ratio is formed by the natural oxidation at a depth within 10 nm from the surface, there is substantially no adverse effect on the electrical properties of the photoreceptor. The elemental composition of the surface layer may have a gradient in the direction of the layer thickness, but in that case, the elemental composition value is a value obtained by averaging it in the direction of layer thickness.

The content of an element such as gallium or oxygen in the surface layer, as well as the distribution thereof in the layer thickness direction, may be determined as follows by Rutherford back scattering (which may also be referred to hereinafter as "RBS").

RBS is performed using an accelerator (trade name: 3SDH PELLETRON, manufactured by NEC Corp.), an end station (trade name: RBS-400, manufactured by CE & A Co., Ltd.), and a system (trade name: 3S-R10). The data is analyzed using the HYPRA program (trade name, manufactured by CE & A Co., Ltd.).

The measurement conditions for RBS include a He++ ion beam energy of 2.275 eV, a detection angle of 160°, a grazing angle with respect to an incident beam of about 109°±2°.

The measurement of RBS is specifically carried out as follows.

First, a He++ ion beam is projected so as to be orthogonally incident on the sample, and a detector is set at 160° with respect to the ion beam, thereby to measure the signals of backscattered He. The elemental composition ratio and the layer thickness are determined from the energy and intensity of the detected He. In order to improve the accuracy for determining the elemental composition ratio and the layer thickness, the spectrum may be measured at two detection angles. The accuracy may be improved by measuring the spectrum at two detection angles where the resolutions in the depth direction or the backscattering dynamics are different, and by cross-checking the data.

The number of He atoms backscattered by target atoms is determined only by the three factors of: 1) the atomic number of the target atoms, 2) the energy of the He atoms before scattering, and 3) the scattering angle. The density is assumed by calculation from the measured composition, and the layer thickness is calculated using this density. The error in the calculation of the density is within 20%.

The amount of hydrogen may be determined as follows by hydrogen forward scattering (which may also be referred to hereinafter as "HFS").

HFS is carried out using an accelerator (trade name: 3SDH PELLETRON, manufactured by NEC Corp.), an end station (trade name: RBS-400, manufactured by CE&A Co., Ltd.) and a system (trade name: 3S-R10). The data is analyzed using the HYPRA program (trade name, manufactured by CE & A Co., Ltd.). The measurement conditions for HFS are as follows.

He++ ion beam energy: 2.275 eV

Detection angle: 160°, Crazing angle with respect to incident beam: 30°

The HFS measurement is carried out by setting a detector at 30° with respect to the He++ ion beam, and setting the sample at 75° with respect to the normal line, whereby signals of hydrogen scattered in front of the sample may be picked up. At this time, the detector may be preferably covered with aluminum foil to remove any He atoms scattered together with hydrogen atoms. Quantification is performed by comparing the hydrogen counts of a reference sample and the sample to be measured, after performing normalization based on the stopping power.

As the reference sample, a sample prepared by H ion implantation into Si, and muscovite are used. Muscovite is known to have a hydrogen concentration of about 6.5 atomic %±1%. H adsorbed at the outermost surface thereof is subtracted by subtracting the amount of H adsorbed on a clean Si surface. There may be also exemplified secondary ion mass spectrometry (SIMS), X-ray photoelectron spectroscopy (XPS), Auger electron spectroscopy (AES), fluorescent X-ray elemental analysis (EDS), energy dispersive fluorescent X-ray analysis (EDX), electron beam microprobe analyzer (EPMA), electron beam energy loss spectroscopy (EELS) and the like, but the measurement method is not limited to these. These methods may be used individually, or in combination of two or more methods.

With regard to the elemental composition data in the depth direction, a method of obtaining the depth profile data from the surface; a method of measuring the surface composition while etching the surface in a vacuum by sputtering or the like; or a method of producing a cross-section sample and measuring the composition by composition mapping of the cross-section may be conceived. However, a method that is adequate for the respective analysis techniques may be used. In any case, the elemental composition determined in the invention is not the composition for the outermost surface, but the composition of the entire surface layer excluding the 10 nm region from the outermost surface thereof.

The organic photosensitive layer formed under the surface layer may have a dynamic hardness of 0.1 GPa to 10 GPa. When the dynamic hardness is set within the above range for the photosensitive layer which serves as a foundation for the formation of the surface layer, depression of the foundation is prevented, and uneven wear at the surface layer and mechanical damages due to repeated use may be more effectively prevented, thus the initial surface properties being maintained.

The dynamic hardness of the organic photosensitive layer represents, in the case of having an undercoat layer and an intermediate layer formed as will be described later, the dynamic hardness of the entire layer including these (that is, the whole layer present between the conductive substrate and the surface layer).

Here, the dynamic hardness means a value (Pa) obtained by indenting a triangular pyramid indenter (made of diamond, apical angle: 115°, tip curvature radius: about 0.1 μm) at a loading rate of 0.05 N/sec using a microhardness tester (trade name: DUH-201 and 202, manufactured by Shimadzu Corp.), measuring the indentation depth [m] and the indentation load [N], and calculating from these measurement values on the basis of the following formula:

$$DH=3.8584P/D$$

wherein DH represents a dynamic hardness ($N/m^2$), that is, (Pa); P represents an indentation load (N); and D represents an indentation depth (m). DH is obtained at an indentation depth in the range of 1.0 μm or less.

Next, the method for forming the surface layer will be described. At the time of forming a surface layer, the surface layer may be formed directly on the organic photosensitive layer so as to contain gallium and oxygen. The surface of the organic photosensitive layer may also be subjected to plasma cleaning.

For the formation of the surface layer, generally known methods for forming thin films may be used. In the case of forming a surface layer on the organic photosensitive layer, the temperature of the organic photosensitive layer, which is the surface of the substrate subjected to film formation, may be 150° C. or lower. Among the methods, plasma CVD is suitable from the viewpoints that the inorganic thin film according to the present exemplary embodiment is formed with good adhesiveness on a foundation such as the organic photosensitive layer; the inorganic thin film having a range of composition according to the present exemplary embodiment is formed with good controllability by means of the supply amount of the raw material; the inorganic thin film is formed at a low temperature (for example, about 10° C. to 60° C.); and the like. In addition to that, catalytic CVD, vacuum deposition, sputtering, ion plating, molecular beam epitaxy and the like are used, but the method is not limited to these.

Figure 4:
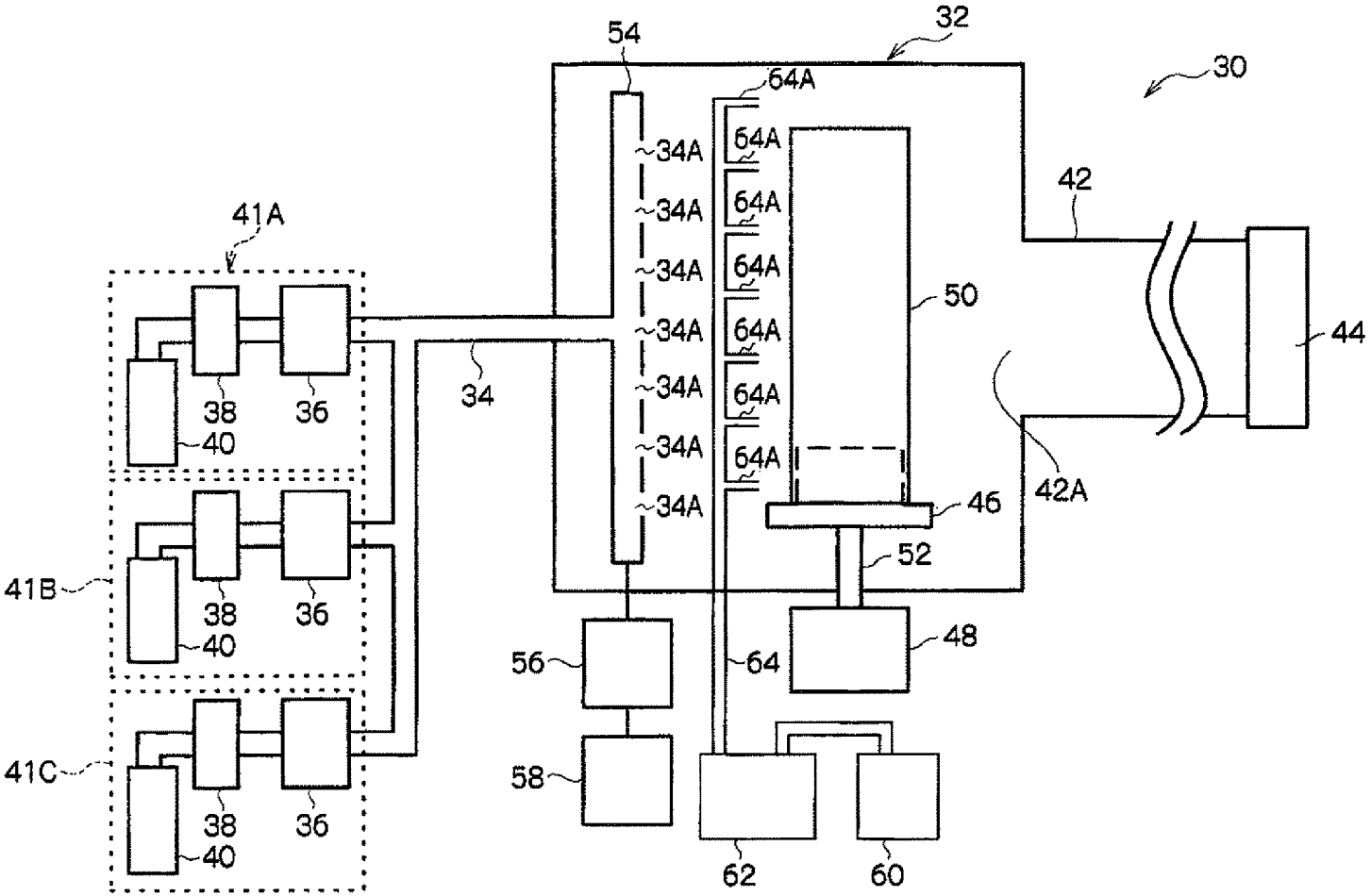
FIG. 4 is a schematic diagram showing an exemplary film forming apparatus used in the invention.

FIG. 4 is a schematic diagram showing an exemplary film forming apparatus used in the formation of the surface layer of an electrophotographic photoreceptor according to the present exemplary embodiment.

The film forming apparatus 30 has a constitution including a vacuum chamber 32 that is vacuum exhausted. Inside the vacuum chamber 32, there is installed a supporting member 46 for supporting an electrophotographic photoreceptor 50 in a state that formation of the surface layer is not yet achieved (hereinafter, referred to as a non-coated photoreceptor), such that the non-coated photoreceptor 50 is rotated with the longitudinal direction of the non-coated photoreceptor 50 being taken as the direction of rotating axis. The supporting member 46 is connected to a motor 48 through a supporting axis 52 for supporting the supporting member 46, and the supporting member 46 is constructed such that the driving force of the motor 48 is transferred to the supporting member 46 through the supporting axis 52.

After the non-coated photoreceptor 50 is held on the supporting member 46, when the motor 48 is driven, and the driving force of the motor 48 is transferred to the non-coated photoreceptor 50 through the supporting axis 52 and the supporting member 46, the non-coated photoreceptor 50 rotates with the longitudinal direction thereof as the direction of rotating axis.

At one end of the vacuum chamber 32, an exhaust pipe 42 for exhausting the gas inside the vacuum chamber 32 is installed. One end of the exhaust pipe 42 is installed to be linked to the inside of the vacuum chamber 32 through the opening 42A of the vacuum chamber 32, while the other end thereof is connected to a vacuum exhausting unit 44. The vacuum exhausting unit 44 includes one or a plurality of vacuum pumps, but if necessary, may also include a device for adjusting the exhaust rate, such as a conductance valve.

When air inside the vacuum chamber 32 is exhausted through the exhaust pipe 42 by driving the vacuum exhausting unit 44, the inside of the vacuum chamber 32 is depressurized to a predetermined pressure (ultimate vacuum). This ultimate vacuum may be 1 Pa or less, or may also be 0.1 Pa or less. In the invention, as will be described later, the elemental composition ratio (oxygen/Group 13 element) is controlled by the ratio of the supply rates of the gallium raw material and oxygen, but when the value of this ultimate vacuum is large, the amount of oxygen in the reaction atmosphere may become larger than the supplied amount due to the effects of oxygen or water in the residual air, and the composition controllability may become poorer.

At a site close to the non-coated photoreceptor 50 installed inside the vacuum chamber 32, a discharge electrode 54 is installed. The discharge electrode 54 is electrically connected to a high frequency power supply 58 through a matching box 56. As for the high frequency power supply 58, for example, a direct current power supply or an alternate current power supply may be used, but from the viewpoint that gas is efficiently excited, a high frequency alternate current power supply may be used.

The discharge electrode 54 is plate-shaped. The discharge electrode 54 is installed such that its longitudinal direction is identical with the direction of the rotating axis (longitudinal direction) of the non-coated photoreceptor 50, and is installed at a predetermined distance away from the peripheral surface of the non-coated photoreceptor 50. The discharge electrode 54 is hollow in shape and has one or a plurality of openings 34A for supplying a plasma-generating gas at the discharge surface. If the discharge electrode 54 does not have a hollow structure and has no opening 34A at the discharge surface, a configuration in which the plasma-generating gas is supplied through a separately installed gas supply port, and is led through between the non-coated photoreceptor 50 and the discharge electrode 54, may also be used. In order to prevent discharge between the discharge electrode 54 and the vacuum chamber 32, the electrode surface other than the surface facing the non-coated photoreceptor 50 may be covered by a member that is earthed by having a clearance of about 3 mm or less.

When high frequency electric power is supplied from the high frequency power supply 58 to the discharge electrode 54 through the matching box 56, electric discharge by the discharge electrode 54 is carried out.

In the region which is inside the vacuum chamber 32 and faces the non-coated photoreceptor 50 through the discharge electrode 54, there is installed a gas supply pipe 34 for supplying gas toward the non-coated photoreceptor 50 inside the vacuum chamber 32 through the interior of the discharge electrode 54 having a hollow structure.

One end of the gas supply pipe 34 is linked to the inside of the discharge electrode 54 (that is, linked to the inside of the vacuum chamber 32 through the discharge electrode 54 and the openings 34A), while the other end is connected respectively to a gas supply unit 41A, a gas supply unit 41B and a gas supply unit 41C.

Each of the gas supply unit 41A, gas supply unit 41B and gas supply unit 41C is constructed to include a mass flow controller (MFC) 36 for regulating the amount of gas supply, a pressure regulator 38, and a gas supply source 40. The respective gas supply sources 40 for the gas supply unit 41A, the gas supply unit 41B and the gas supply unit 41C are connected to the other end of the gas supply pipe 34, through the pressure regulator 38 and the MFC 36.

Gas inside the gas supply source 40 is supplied toward the non-coated photoreceptor 50 in the vacuum chamber 32 through the gas supply pipe 34, the discharge electrode 54 and the openings 34A, while the supply pressure is regulated by the pressure regulator 38, and the amount of gas supply is regulated by the MFC 36.

The type of the gas filled in the respective gas supply sources 40 included in the gas supply unit 41A, the gas supply unit 41B and the gas supply unit 41C, may be of the same type, but in the case where the treatment is performed using multiple types of gases, gas supply sources 40 filled with different types of gases may be used. In this case, a gas mixture prepared by supplying the different types of gases from the respective gas supply sources 40 of the gas supply unit 41A, the gas supply unit 41B and the gas supply unit 41C to the gas supply pipe 34 and mixing these gases is supplied toward the non-coated photoreceptor 50 inside the vacuum chamber 32 through the discharge electrode 54 and the openings 34A.

A raw material gas containing gallium is also supplied to the non-coated photoreceptor 50 in the vacuum chamber 32. The raw material gas is introduced from a raw material gas supply source 62 to the vacuum chamber 32, by a gas inlet pipe 64 having shower nozzles 64A at the pipe end. As for the raw material gas, for example, a gaseous compound containing gallium, such as trimethylgallium or triethylgallium, metal gallium, or the like may be used. As the oxygen source, a substance containing oxygen, such as $O_2$, may be used.

In the example shown in FIG. 4, the discharge method involving the discharge electrode 54 is described on the basis of capacitive mode, but the method may be of inductive mode.

Film formation is, for example, carried out as follows. First, while the interior of the vacuum chamber 32 is depressurized to a predetermined pressure by the vacuum exhausting unit 44, high frequency electric power is supplied from the high frequency power supply 58 to the discharge electrode 54 through the matching box 56, and at the same time, a plasma-generating gas is introduced from the gas supply pipe 34 to the vacuum chamber 32. At this time, plasma is formed such that the plasma radiates from the discharge surface side of the discharge electrode 54 to the opening 42A side of the exhaust pipe 42.

The pressure inside the vacuum chamber 32 at the time of plasma formation may be 1 Pa to 500 Pa.

According to the present exemplary embodiment, the plasma-generating gas contains oxygen. The plasma-generating gas may also be a gas mixture further containing an inert gas such as He or Ar, or a non-film forming gas such as $H_2$. This non-film forming gas or inert gas is used, for example, for controlling the reaction atmosphere, such as the pressure inside the reaction vessel. In particular, hydrogen is important for reactions at low temperatures, as will be described later.

Subsequently, hydrogen from a carrier gas supply source 60 is passed through the raw material gas supply source 62, to dilute trimethylgallium (an organometallic compound containing gallium) gas using hydrogen as a carrier gas, and this hydrogen-diluted gas is introduced into the vacuum chamber 32 through the gas inlet pipe 64 and the shower nozzles 64A. Thereby, activated oxygen and trimethylgallium are allowed to react in an atmosphere containing active hydrogen, and thus a film containing hydrogen, oxygen and gallium is formed on the surface of the non-coated photoreceptor 50.

In the present exemplary embodiment, a film of a compound of gallium and oxygen containing hydrogen may also be formed on the non-coated photoreceptor 50, by introducing a mixture of $O_2$ gas and $H_2$ gas into the discharge electrode 54 as described above, and at the same time, making an active species to thereby decompose trimethylgallium gas.

When hydrogen gas and oxygen gas are simultaneously activated in the plasma, and reacted with an organometallic compound containing gallium, an etching effect of a hydrocarbon group contained in the organometal gas, such as a methyl group or an ethyl group, is obtained by means of the activated hydrogen generated by plasma discharge. In this manner, a film of a compound containing gallium and oxygen, which has a film quality equivalent to the film quality obtained from high temperature (for example, 200° C. or higher but 600° C. or lower) growth, may be formed even at low temperature, on the surface of an organic material (organic photosensitive layer) without damaging the organic material.

Specifically, for example, the hydrogen gas concentration in the plasma-generating gas supplied for activation may be 10% by volume or more. If the hydrogen gas concentration is less than 10% by volume, the etching reaction may not occur sufficiently at low temperatures, and as compared to the case where the hydrogen gas concentration is 10% by volume or more, a gallium oxide compound having a high hydrogen content is produced, thus often resulting in a film unstable in the atmosphere and having insufficient water resistance.

When the surface layer is formed by plasma CVD, the elemental composition ratio of O/Ga is controlled by, for example, the supply amounts of the gallium raw material and the oxygen raw material. In this case, the gas supply molar ratio of oxygen gas to trimethylgallium (TMGa) gas, $[O_2]/[TMGa]$, may 0.1 to 10.

Also in the cases of other methods, the growth atmosphere is controlled by altering the gas supply amounts, or is controlled by the ratio of gallium and oxygen contained in the target material in the process of sputtering or the like.

The temperature at the surface of the non-coated photoreceptor 50 during the film formation is not particularly limited, but the treatment may be performed at a temperature of 0° C. or higher but 150° C. or lower. The temperature at the surface of the non-coated photoreceptor 50 may also be 100° C. or lower. Furthermore, even if the temperature at the surface of the non-coated photoreceptor 50 is 150° C. or lower, when the surface temperature is increased to above 150° C. under the effects of plasma, the organic photosensitive layer may be damaged by heat. Thus, it is possible to set the temperature at the surface of the non-coated photoreceptor 50, with this effect taken into consideration.

The surface temperature of the non-coated photoreceptor 50 may be controlled by a method not depicted in the drawings, or may be subjected to natural temperature elevation during the discharge. In the case of heating the non-coated photoreceptor 50, the heater may be installed on the outside or inside of the non-coated photoreceptor 50. In the case of cooling the non-coated photoreceptor 50, a coolant gas or liquid may be circulated inside the non-coated photoreceptor 50.

If it is desired to avoid temperature elevation of the non-coated photoreceptor 50 due to the discharge, it is effective to adjust the high energy gas stream colliding against the surface of the non-coated photoreceptor 50. In this case, the conditions such as gas flow rate, discharge output and pressure may be regulated to obtain a desired temperature.

The plasma generating method used in the film forming apparatus 30 shown in FIG. 4 utilizes a high frequency oscillator, but the plasma generating method is not limited to this, and may also utilize, for example, a microwave oscillator or an apparatus based on the electro cyclotron resonance technique or helicon plasma technique. In the case of a high frequency oscillator, the oscillator may be of inductive type or capacitive type.

In the present exemplary embodiment, the discharge electrode 54, high frequency power supply 58, matching box 56, gas supply pipe 34, MFC 36, pressure regulator 38 and gas supply source 40 are used as a set of plasma generating apparatus, but two or more different types of such plasma generating apparatuses may be used in combination, or two or more of the apparatuses of the same type may be used in combination. Furthermore, a capacitively coupled plasma CVD apparatus having a cylindrical electrode which surrounds a cylindrical non-coated photoreceptor 50 may be used, or an apparatus inducing discharge between parallel plate electrodes and the non-coated photoreceptor 50 may also be used.

In the case of using two or more different types of plasma generating apparatuses, it is necessary to generate discharge simultaneously at the same pressure. There may be provided a pressure difference between the discharging region and the film forming region (the section where the non-coated photoreceptor 50 is installed). These apparatuses may be disposed in series with respect to the gas stream formed to extend from the section of gas introduction to the section of gas exhaust within the treatment apparatus, or each of the apparatuses may be disposed to face the film forming surface of the non-coated photoreceptor 50.

Discharge may be performed under atmospheric pressure. Here, the atmospheric pressure means 70,000 Pa or higher but 110,000 Pa or lower. In this case, when He or Ar gas as a noble gas is mixed with hydrogen, and the discharge is performed using this mixture, stabilization of the discharge is easily achieved.

As the gas containing gallium, triethylgallium may be used instead of trimethylgallium gas, or a mixture of two or more of these compounds may also be used.

By means of the method as described above, activated hydrogen, oxygen and gallium are made to be present on the photoreceptor, and the activated hydrogen has an effect of detaching the hydrogen atoms in the hydrocarbon group constituting the organometallic compound, such as a methyl group or an ethyl group, as molecules. Therefore, on the surface of the photoreceptor, there is formed a surface layer formed of a hard film in which hydrogen, oxygen and gallium constitute three-dimensional bonding.

The above-described method for forming the surface layer has been described with reference to an example in which the surface layer contains hydrogen, oxygen and gallium as the constituent elements. However, in the case where a surface layer is constructed as a layer containing oxygen and gallium as the constituent elements (not containing hydrogen), the surface layer is formed by, for example, sputtering, electron beam deposition, or molecular beam epitaxy.

Hereinafter, another configuration of the electrophotographic photoreceptor according to the present exemplary embodiment will be described in detail.

The electrophotographic photoreceptor according to the present exemplary embodiment has a layer configuration in which an organic photosensitive layer and a surface layer are laminated in this order on a conductive substrate. If necessary, intermediate layers such as an undercoat layer may be provided between the two layers. The organic photosensitive layer may include two or more layers as described above, which may have separated functions.

The organic photosensitive layer may be composed of a separate charge generating layer and a separate charge transport layer which have separated functions. With respect to the layer configuration of separated functions, the charge generating layer and the charge transport layer may be disposed such that the charge generating may be at the surface side, or the charge transport layer may be at the surface side. If necessary, an undercoat layer may be provided between the conductive substrate and the organic photosensitive layer. An intermediate layer such as a buffering layer may also be provided between the surface layer and the organic photosensitive layer.

The organic polymer compound contained in the organic photosensitive layer may be thermoplastic or thermosetting, or may be formed by reacting two kinds of molecules. An intermediate layer may be provided between the organic photosensitive layer and the surface layer, from the viewpoint of improving the hardness or expansion coefficient, controlling the elasticity, improving the adhesiveness, or the like. The intermediate layer may be formed of a material having properties that are intermediate between the properties of the surface layer and the properties of the organic photosensitive layer (the charge transport layer when it is a layer of separated functions). If an intermediate layer is to be provided, the intermediate layer may function as a layer for trapping charges.

The organic photosensitive layer may be an organic photosensitive layer composed of a separate charge generating layer and a separate charge transport layer which have separated functions (see FIG. 1 and FIG. 2), or alternatively, may be a single layered organic photosensitive layer with integrated functions (see FIG. 3). In the case of a layer of separated functions, the organic photosensitive layer may have a charge generating layer provided at the surface side of the electrophotographic photoreceptor, or may have a charge transport layer provided at the surface side thereof. Hereinafter, explanation will be carried out mainly on the organic photosensitive layer with separated functions.

In the case where the surface layer is formed on the organic photosensitive layer by the method described below, a layer for absorbing shortwave radiation such as ultraviolet rays may be provided in advance on the surface of the organic photosensitive layer before forming the surface layer, in order to prevent degradation of the organic photosensitive layer under irradiation with a shortwave electromagnetic radiation other than heat, or the like.

A layer containing an ultraviolet absorbent (for example, a layer formed by coating or the like, in which an ultraviolet absorbent is dispersed in a polymer resin) may also be provided on the surface of the organic photosensitive layer.

As such, when an intermediate layer is provided on the surface of the photoreceptor before forming the surface layer, the influence exerted on the organic photosensitive layer by ultraviolet rays in the case of forming the surface layer, or by shortwave radiation such as ultraviolet rays from corona discharge or various light sources in the case of using the photoreceptor in an image forming apparatus, is inhibited.

The surface layer may be either amorphous or crystalline, but in view of ameliorating the smoothness of the photoreceptor surface, the surface layer may be amorphous.

Next, the conductive substrate will be described. Examples of the conductive substrate include a metal drum formed from aluminum, copper, iron, stainless steel, zinc, nickel or the like; a material produced by vapor depositing a metal such as aluminum, copper, gold, silver, platinum, palladium, titanium, nickel-chrome, stainless steel or copper-indium, on a base material such as sheet, paper, plastic or glass; a material produced by vapor depositing an electrically conductive metal compound such as indium oxide or tin oxide, on the above-mentioned base material; a material produced by laminating a metal foil on the above-mentioned base material; a material conductively treated by dispersing carbon black, indium oxide, powdered tin oxide-antimony oxide, powdered metal, copper iodide or the like in a binding resin, and coating the dispersion on the above-mentioned base material; and the like. The shape of the conductive substrate may be any of a drum shape, a sheet shape and a plate shape. Here, the term "electrical conductive" means that the volume resistivity is $10^9$ Ω·cm or less.

In the case of using a metallic pipe substrate as the conductive substrate, the surface of the metallic pipe substrate may be in an untreated state, or the substrate surface may be roughened in advance by a surface roughening treatment.

Such surface roughening treatment prevents, in the case of using a coherent light source such as laser beam as the exposure light source, wood grain-like density unevenness which may be generated inside the photoreceptor by interference light. Examples of the surface treatment methods include mirror cutting, etching, anodic oxidation, rough cutting, centerless grinding, sand blast, wet homing and the like.

In particular, a substrate produced by applying anodic oxidation treatment to the surface of an aluminum substrate as follows may be used as a conductive substrate, from the viewpoint of improving the adhesiveness to the organic photosensitive layer or improving the film forming properties.

Hereinafter the method for producing a conductive substrate with anodic oxidation treatment applied to the surface, will be described.

First, pure aluminum or an aluminum alloy (for example, aluminum or aluminum alloy having an alloy number in the 1000's, 3000's or 6000's as defined in JISH4080) is provided as the substrate. Subsequently, the substrate is subjected to anodic oxidation treatment. The anodic oxidation treatment is performed in an acid bath of chromic acid, sulfuric acid, oxalic acid, phosphoric acid, boric acid, sulfamic acid or the like, but a treatment using a sulfuric acid bath is frequently used. The anodic oxidation treatment is performed under the conditions of, for example, a sulfuric acid concentration of 10% by weight to 20% by weight, a bath temperature of 5° C. or higher but 25° C. or lower, a current density of 1 $A/dm^2$ to 4 $A/dm^2$, an electrolytic voltage of 5 V or higher but 30 V or lower, and a treatment time of 5 minutes or longer but 60 minutes or shorter, but the conditions are not limited thereto.

The anodic oxidation film thus formed on the aluminum substrate is porous, highly insulating, and has a very unstable surface, and thus after the film formation, the properties thereof are prone to change over time. To prevent this change in the properties thereof, the anodic oxidation film is further subjected to a pore sealing treatment. Examples of the method for pore sealing treatment include a method of immersing the anodic oxidation film in an aqueous solution containing nickel fluoride or nickel acetate, a method of immersing the anodic oxidation film in boiling water, a method of treating the anodic oxidation film with pressurized steam, and the like. Among these methods, the method of immersing the anodic oxidation film in an aqueous solution containing nickel acetate is particularly frequently used.

On the surface of the anodic oxidation film thus treated by a pore sealing treatment, metal salts and the like attached by the pore sealing treatment remain in excess. When these metal salts and the like remain in excess on the anodic oxidation film of the substrate, these substances exert adverse effects on the quality of the coating films formed on the anodic oxidation film. In addition, since low resistance components generally tend to remain thereon, when this substrate is used in the photoreceptor to form images thereon, the law resistant components may cause scumming.

Accordingly, after the pore sealing treatment, in order to remove those metal salts and the like attached by the pore sealing treatment, the anodic oxidation film is subjected to washing treatment. The washing treatment may be performed by washing the substrate once with pure water, or the washing of the substrate may also be carried out through multistage washing processes. Here, as for the washing solution for the final washing process, a washing solution as pure as possible (deionized) is used. It is possible to perform washing by physical rubbing using a contacting member such as brush, in any one step during the multistage washing processes.

The layer thickness of the anodic oxidation film thus formed on the surface of the conductive substrate, may be in the range of about 3 μm to 15 μm. On the anodic oxidation film, a layer called barrier layer is present along the porous-shaped outermost surface of the porous anodic oxidation film. The layer thickness of the barrier layer may be 1 nm to 100 nm in the electrophotographic photoreceptor according to the present exemplary embodiment. As such, a conductive substrate treated by anodic oxidation is obtained.

In the conductive substrate thus obtained, the anodic oxidation film formed on the substrate by anodic oxidation treatment has high carrier blocking properties. Therefore, the point defects (black spots, scumming) that are generated when a photoreceptor utilizing such conductive substrate is mounted on an image forming apparatus, and reversal development (negative/positive development) is performed, are prevented, and at the same time, the phenomenon of current leakage from a contact charger, which is likely to occur during contact charging, is prevented. Furthermore, when the anodic oxidation film is subjected to a pore sealing treatment, changes over time in the properties of the anodic oxidation film after the production thereof are prevented. When washing of the conductive substrate is performed after the pore sealing treatment, metal salts and the like attached to the surface of the conductive substrate due to the pore sealing treatment, may be removed. Thus, when images are formed by an image forming apparatus equipped with a photoreceptor produced using this conductive substrate, the generation of scumming is suppressed.

Subsequently, the organic photosensitive layer provided on the conductive substrate will be described in detail. The organic photosensitive layer consists mainly of a charge generating layer and a charge transport layer, but as discussed above, an undercoat layer or an intermediate layer may be provided, according to necessity.

First, examples of the material constituting the undercoat layer include acetal resins such as polyvinylbutyral; polymeric resin compounds such as polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins, as well as organometallic compounds containing zirconium, titanium, aluminum, manganese, silicon atoms and the like.

These compounds are used, for example, individually or as mixtures or polycondensates of a plurality of the compounds. Among these, the organometallic compounds containing zirconium or silicon may be preferably used, since their residual potential is low and their potential change due to an environment is reduced, and at the same time, their potential change due to repeated use is also reduced. The organometallic compounds may be used individually, or as mixtures of two or more species, or may also be used as mixtures with the aforementioned binding resins.

Examples of organosilicon compounds (organometallic compounds containing silicon atoms) include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, γ-chloropropyltrimethoxysilane and the like. Among these, silane coupling agents such as vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl) ethyltrimethoxysilane, N-2-(aminoethyl)3-aminopropyltrimethoxysilane, N-2-(aminoethyl)3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane may be used.

Examples of organozirconium compounds (organometallic compounds containing zirconium) include zirconium butoxide, ethyl zirconium acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, isostearate zirconium butoxide, and the like.

Examples of organotitanium compounds (organometallic compounds containing titanium) include tetraisopropyl titanate, tetra-normal-butyl titanate, butyl titanate dimer, tetra(2-ethylhexyl)titanate, titanium acetylacetonate, polytitanium acetylacetonate, titanium octylene glycolate, titanium lactate ammonium salts, titanium lactate, titanium lactate ethyl ester, titanium triethanolaminate, polyhydroxytitanium stearate, and the like.

Examples of organoaluminum compounds (organometallic compound containing aluminum) include aluminum isopropylate, monobutoxyaluminum diisopropylate, aluminum butylate, ethylacetoacetate aluminum diisopropylate, aluminum tris(ethylacetoacetate), and the like.

As for the solvent used in the coating liquid for undercoat layer formation for forming an undercoat layer, there may be mentioned known organic solvents, for example, aromatic hydrocarbon solvents such as toluene and chlorobenzene; aliphatic alcohol solvents such as methanol, ethanol, n-propanol, isopropanol and n-butanol; ketone solvents such as acetone, cyclohexanone and 2-butanone; halogenated aliphatic hydrocarbon solvents such as methylene chloride, chloroform and ethylene chloride; cyclic or straight-chained ether solvents such as tetrahydrofuran, dioxane, ethylene glycol and diethyl ether; ester solvents such as methyl acetate, ethyl acetate and n-butyl acetate; and the like. These solvents may be used individually, or as mixtures of two or more species. As for the solvent used in the case of mixing two or more solvents, any solvent may be used as long as the solvent mixture is capable of dissolving a binding resin.

The formation of an undercoat layer is carried out by first providing a coating liquid for undercoat layer formation prepared by dispersing and mixing a coating agent for undercoat layer and a solvent, and applying the coating liquid on the surface of the conductive substrate. As the method for applying the coating liquid for undercoat layer formation, a conventional method such as dip coating, ring coating, wire bar coating, spray coating, blade coating, knife coating or curtain coating, may be used. When an undercoat layer is to be formed, the layer may be formed such that the layer thickness is 0.1 μm to 3 μm. When the layer thickness of the undercoat layer is set within such layer thickness range, desensitization, and elevation of potential due to repeated use may be prevented without making the electrical barrier excessively strong.

When an undercoat layer is formed on the conductive substrate as such, the wetting properties required when a layer to be formed on the undercoat layer is formed by coating, may be improved, and at the same time, the function of the undercoat layer as an electrically blocking layer is accomplished.

The surface roughness of the undercoat layer may be adjusted to have a degree of roughness in the range of about 1/(4n)-fold (provided that n is the refractive index of the layer provided on the outer side of the undercoat layer) to one-fold the wavelength of the exposing laser γ to be used. Adjustment of the surface roughness may be carried out by adding resin particles to the coating liquid for undercoat layer formation. Then, when a photoreceptor produced by adjusting the surface roughness of the undercoat layer is used in an image forming apparatus, images with interference fringes caused by the laser light source may be prevented.

As the resin particles, silicone resin particles, crosslinked PMMA resin particles and the like are used. For an adjustment of surface roughness, the undercoat layer surface may be polished. As for the polishing method, buff polishing, sand blast treatment, wet horning, grinding treatment or the like may be used. In the photoreceptor used in image forming apparatuses having a configuration of positive charging, since the laser incident light is absorbed near the outermost surface of the photoreceptor and further scattered within the organic photosensitive layer, the adjustment of the surface roughness of the undercoat layer is not needed so strongly.

Various additives may be added to the coating liquid for undercoat layer formation, from the viewpoints of improving electrical properties, improving the environmental stability and improving the image quality. Examples of the additives include electron transporting materials such as quinone compounds such as chloranil, bromoanil and anthraquinone; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole or 2,5-bis(4-naphthyl)-1,3,4-oxadiazole and 2,5-bis(4-diethylaminophenyl)-1,3,4-oxadiazole; xanthone compounds; thiophene compounds; diphenoquinone compounds such as 3,3',5,5'-tetra-t-butyldiphenoquinone; electron transporting pigments such as polycyclic condensation pigments and azo pigments; known materials such as zirconium chelate compounds, titanium chelate compounds, aluminum chelate compounds, titanium alkoxide compounds, organotitanium compounds and silane coupling agents; and the like.

Specific examples of the silane coupling agents as used herein include, but not limited to, silane coupling agents such as vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane and γ-chloropropyltrimethoxysilane.

Specific examples of the zirconium chelate compounds include zirconium butoxide, ethyl zirconium acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, isostearate zirconium butoxide, and the like.

Specific examples of the titanium chelate compounds include tetraisopropyl titanate, tetra-normal-butyl titanate, butyl titanate dimer, tetra(2-ethylhexyl)titanate, titanium acetylacetonate, polytitanium acetylacetonate, titanium octylene glycolate, titanium lactate ammonium salt, titanium lactate, titanium lactate ethyl ester, titanium triethanolaminate, polyhydroxytitanium stearate, and the like.

Specific examples of the aluminum chelate compounds include aluminum isopropylate, monobutoxyaluminum diisopropylate, aluminum butylate, diethyl acetoacetate aluminum diisopropylate, aluminum tris(ethylacetoacetate), and the like.

These additives may be used individually, but may also be used as mixtures or polycondensates of a plurality of compounds.

The coating liquid for undercoat layer formation described above may contain at least one electron accepting material. Specific examples of the electron accepting material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid, and the like. Among these, more specifically, a fluorenone compound, a quinone compound, or a benzene derivative having an electron withdrawing substituent such as Cl, CN or $NO_2$ may also be used. Thereby, an attempt may be made to improve the photosensitivity of the organic photosensitive layer, or to reduce the residual potential, and at the same time, deterioration of photosensitivity due to repeated use may be reduced, thus the density unevenness is prevented in the toner image formed by an image forming apparatus equipped with a photoreceptor including an electron accepting material in the undercoat layer.

In place of the coating agent for undercoat layer described above, it is also acceptable to use the following dispersed coating agent for undercoat layer. Thereby, since the resistance value of the undercoat layer is appropriately adjusted, accumulation of residual charges is repressed, and at the same time, the layer thickness of the undercoat layer may be thickened, thus leakage resistance of the photoreceptor, and particularly prevention of leakage during contact charging may be achieved.

This dispersed coating agent for undercoat layer may be exemplified by a dispersion in a binding resin of a powder of a metal such as aluminum, copper, nickel or silver; an electrically conductive metal oxide such as antimony oxide, indium oxide, tin oxide or zinc oxide; an electrically conductive substance such as carbon fiber, carbon black or graphite powder; or the like. As the electrically conductive metal oxide, metal oxide particles having an average primary particle diameter of 0.5 μm or less may be used. If the average primary particle diameter is too large, localized formation of electrically conductive paths is likely to take place, leakage of current may occur, and as a result, there may be fogging or leakage of large current from the electric charger, in some cases. It is necessary to adjust the undercoat layer to have an appropriate resistance value, so as to improve the leakage resistance. Therefore, the metal oxide particles described above may have a powder resistance of about $10^2$ Ω·cm to $10^{11}$ Ω·cm.

Furthermore, if the resistance value of the metal oxide particles is lower than the lower limit of the above range, sufficient leakage resistance may not be obtained, whereas if the resistance value is higher than the upper limit of the range, the residual potential may be increased. Accordingly, particles of a metal oxide having a resistance value within the above-mentioned range, such as tin oxide, titanium oxide or zinc oxide, may be used. The metal oxide particles may also be used as mixtures of two or more species. When the metal oxide particles are subjected to a surface treatment with a coupling agent, the resistance of the powder may be controlled. As for the coupling agent used in this case, the same materials as those used in the above-described coating liquid for undercoat layer formation, may be used. These coupling agents may be used as mixtures of two or more species.

This surface treatment of metal oxide particles may be performed by any known method, and a dry method or a wet method may be used.

In the case where a dry method is used, first, the metal oxide particles are dried by heating to remove the surface adsorbed water. By removing the surface adsorbed water, a coupling agent may be adsorbed onto the surface of the metal oxide particles. Subsequently, while the metal oxide particles are stirred with a mixer having high shear force, or the like, the coupling agent is added dropwise directly or as a solution in an organic solvent or water, or sprayed together with dry air or nitrogen gas. Thus, the unevenness in adsorption is restrained, and the treatment is achieved. When the coupling agent is to be added dropwise or sprayed, the process may be carried out at a temperature of 50° C. or higher. After the adding or spraying of the coupling agent, baking may be further performed at 100° C. or above. Under the effect of baking, the coupling agent is cured, and a firm chemical reaction between the coupling agent and the metal oxide particles is induced. The baking may be performed at any temperature and duration ranges, as long as desired electrophotographic properties may be obtained at the selected temperature and time.

When a wet method is to be used, in the same manner as in the dry method, the surface adsorbed water is first removed from the metal oxide particles. As a method for removing this surface adsorbed water, in addition to the process of heat drying as in the dry method, there may be performed a method of removing the surface adsorbed water while the particles are heated with stirring in a solvent which is used in the surface treatment, a method of removing the surface adsorbed water by azeotropical boiling with the solvent, or the like. Subsequently, the metal oxide particles are dispersed in a solvent using stirring, ultrasonic, a sand mill, an attriter, a ball mill or the like, a solution of the coupling agent is added thereto and stirred or dispersed in the dispersion, and then the solvent is removed. Thus, the unevenness in adsorption is restrained, and the treatment is achieved. After the removal of the solvent, baking may be further performed at 100° C. or above. The baking is carried out at any temperature and duration range, as long as desired electrophotographic properties may be obtained at the selected temperature and time.

The amount of the surface treating agent for the metal oxide particles is required to be an amount capable of resulting in desired electrophotographic properties. The electrophotographic properties are affected by the amount of the surface treating agent attached to the metal oxide particles after the surface treatment. In the case of silane coupling agents, the amount of attached agent is determined from the intensity of Si (attributable to the silane coupling agent), and the intensity of the main metal element in the metal oxide being used, which are measured by fluorescent X-ray analysis. This intensity of Si measured by fluorescent X-ray analysis may be $1.0\times10^{-5}$-fold to $1.0\times10^{-3}$-fold the intensity of the main metal element in the metal oxide being used. If the intensity of Si is lower than this range, defects in the image quality, such as fogging, may be likely to occur. If the intensity of Si exceeds the range, a decrease in the density resulting from the elevation of residual potential may be likely to occur.

Examples of the binding resin contained in the dispersed coating agent for undercoat layer include known polymer resin compounds, such as acetal resins such as polyvinylbutyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins and urethane resins, as well as charge transporting resins having charge transporting groups, electrically conductive resins such as polyaniline, and the like.

Among them, it is possible to use a resin which is insoluble in the coating solvent for the layer formed on the undercoat layer, and particularly it is possible to use phenolic resins, phenol-formaldehyde resins, melamine resins, urethane resins, epoxy resins and the like. The ratio of the metal oxide particles and the binding resin in the dispersed coating liquid for undercoat layer formation is arbitrarily set in a range where desired photoreceptor properties are obtained.

As the method for dispersing the metal oxide particles which have been surface treated by the above-described methods in a binding resin, there may be mentioned a method of using a media disperser such as a ball mill, a vibratory ball mill, an attriter, a sand mill or a horizontal sand mill, or a medialess disperser such a stirrer, an ultrasonic disperser, a roll mill or a high pressure homogenizer A collision method in which the dispersion liquid is dispersed at a high pressure with a high pressure homogenizer through liquid-liquid collision or liquid-wall collision, or a penetration method in which the dispersion liquid is dispersed by allowing the dispersion liquid to pass through fine flow channels at a high pressure, may be mentioned.

The method for forming an undercoat layer using this dispersed coating agent for undercoat layer may be carried out in the same manner as in the above-described method for forming an undercoat layer using a coating agent for undercoat layer.

Next, the organic photosensitive layer, specifically the charge transport layer and the charge generating layer, will be described.

Examples of the charge transporting material used in the charge transport layer include the following. That is, hole transporting materials such as oxadiazole derivatives such as 2,5-bis(p-diethylaminophenyl)-1,3,4-oxadiazole; pyrazoline derivatives such as 1,3,5-triphenyl-pyrazoline or 1-[pyridyl-(2)]-3-(p-diethylaminostyryl)-5-(p-diethylaminostyryl) pyrazoline; aromatic tertiary amino compounds such as triphenylamine, tri(p-methyl)phenylamine, N,N-bis(3,4-dimethylphenyl)biphenyl-4-amine, dibenzylaniline and 9,9-dimethyl-N,N-di(p-tolyl)fluorenone-2-amine; aromatic tertiary diamino compounds such as N,N'-diphenyl-N,N'-bis(3-methylphenyl)-[1,1-biphenyl]-4,4'-diamine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenylhydrazone, 4-diphenylaminobenzaldehyde-1,1-diphenylhydrazone, [p-(diethylamino)phenyl](1-naphthyl)phenylhydrazone, 1-pyrenediphenylhydrazone, 9-ethyl-3-[(2methyl-1-indolinylimino)methyl]carbazole, 4-(2-methyl-1-indolinyliminomethyl)triphenylamine, 9-methyl-3-carbazole diphenylhydrazone, 1,1-di-(4,4'-methoxyphenyl) acrylaldehyde diphenylhydrazone and β,β-bis(methoxyphenyl)vinyldiphenylhydrazone; quinazoline derivatives such as 2-phenyl-4-styryl-quinazoline; benzofuran derivatives such as 6-hydroxy-2,3-di(p-methoxyphenyl)-benzofuran; α-stilbene derivatives such as p-(2,2-diphenylvinyl)-N,N-diphenylaniline; enamine derivatives; carbazole derivatives such as N-ethylcarbazole; and poly-N-vinylcarbazole and derivatives thereof, are used. There may be also mentioned polymers having groups formed of the above compounds in the main chain or in the side chain. These charge transporting materials are used individually, or in combination of two or more species.

As for the binding resin used in the charge transport layer, any resin may be used, and it is possible that the binding resin is compatible with the charge transporting material, and has appropriate strength.

Examples of this binding resin include various polycarbonate resins formed from bisphenol A, bisphenol Z, bisphenol C, bisphenol TP or the like, or copolymers thereof; polyallylate resins or copolymers thereof; polyester resins, methacrylic resins, acrylic resins, polyvinyl chloride resins, polyvinylidene chloride resins, polystyrene resins, polyvinyl acetate resins, styrene-butadiene copolymer resins, vinyl chloride-vinyl acetate copolymer resins, vinyl chloride-vinyl acetate-maleic anhydride copolymer resins, silicone resins, silicone-alkyd resins, phenol-formaldehyde resins, styrene-acrylic copolymer resins, styrene-alkyd resins, poly-N-vinylcarbazole resins, polyvinylbutyral resins, polyphenylene ether resins, and the like. These resins are used individually or as mixtures of two or more species.

The molecular weight of the binding resin used in the charge transport layer is selected in accordance with the layer thickness of the organic photosensitive layer, or the film forming conditions such as solvent, but typically, the viscosity average molecular weight may be 3000 to 300,000, or may be 20,000 to 200,000.

The mixing ratio of the charge transporting material and the binding resin may be in the range of 10:1 to 1:5.

The charge transport layer and/or the charge generating layer that will be described later may contain additives such as an antioxidant, a photostabilizer and a thermal stabilizer, for the purpose of preventing the deterioration of the photoreceptor caused by the ozone generated in the image forming apparatus, oxidizing gases, light or heat.

Examples of the antioxidant include hindered phenol, hindered amine, para-phenylenediamine, arylalkane, hydroquinone, spiro-chroman, spiro-indanone or derivatives thereof, organic sulfur compounds, organic phosphorus compounds, and the like.

Specific exemplary compounds of the antioxidant include phenolic antioxidants such as 2,6-di-t-butyl-4-methylphenol, styrenized phenol, n-octadecyl-3-(3',5'-di-t-butyl-4'-hydroxyphenyl)-propionate, 2,2'-methylene-bis-(4-methyl-6-t-butylphenol), 2-t-butyl-6-(3'-t-butyl-5'-methyl-2'-hydroxybenzyl)-4-methylphenyl acrylate, 4,4'-butylidene-bis-(3-methyl-6-t-butylphenol), 4,4'-thio-bis-(3-methyl-6-t-butyl-phenol), 1,3,5-tris(4-t-butyl-3-hydroxy-2,6-dimethylbenzyl)isocyanurate, tetrakis-[methylene-3-(3',5'-di-t-butyl-4'-hydroxyphenyl)propionate]-methane, 3,9-bis[2-[3-(3-t-butyl-4-hydroxy-5-methylphenyl)propionyloxy]-1,1-dimethylethyl]-2,4,8,10-tetraoxaspiro[5,5]undecane, stearyl 3-3',5'-di-t-butyl-4'-hydroxyphenyl)propionate, and the like.

Examples of the hindered amine compounds include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensates, poly[{6-(1,1,3,3-tetramethylbutyl)amino-1,3,5-triazin-2,4-diyl}{(2,2,6,6-tetramethyl-4-piperidyl) imino}hexamethylene{(2,3,6,6-tetramethyl-4-piperidyl) imino}], bis(1,2,2,6,6-pentamethyl-4-piperidyl)2-(3,5-di-t-butyl-4-hydroxybenzyl)-2-n-butylmalonate, N,N'-bis(3-aminopropyl)ethylenediamine-2,4-bis[N-butyl-N-(1,2,2,6,6-pentamethyl-4-piperidyl)amino]-6-chloro-1,3,5-triazine condensate, and the like.

Examples of the organic sulfur-containing antioxidants include dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, 2-mercaptobenzimidazole, and the like.

Examples of the organic phosphorus-containing antioxidants include trisnonylphenyl phosphite, triphenyl phosphite, tris(2,4-di-t-butylphenyl)-phosphite, and the like.

The organic sulfur-containing and organic phosphorus-containing antioxidants are known as secondary antioxidants, and when they are used in combination with primary antioxidants such as phenol-based or amine-based antioxidants, the anti-oxidizing effects may be increased synergistically.

Examples of the photostabilizer include derivatives of benzophenones, benzotriazoles, dithiocarbamates, tetramethylpiperidines and the like.

Examples of the benzophenone photostabilizer include 2-hydroxy-4-methoxybenzophenone, 2-hydroxy-4-octoxybenzophenone, 2,2'-di-hydroxy-4-methoxybenzophenone, and the like.

Examples of the benzotriazole photostabilizer include 2-(2'-hydroxy-5'-methylphenyl)-benzotriazole, 2-[2'-hydroxy-3'-(3",4",5",6"-tetra-hydrophthalimidomethyl)-5'-methylphenyl]-benzotriazole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3',5'-t-butylphenyl)-benzotriazole, 2-(2'-hydroxy-5'-t-octylphenyl)-benzotriazole, 2-(2'-hydroxy-3',5'-di-t-amylphenyl)-benzotriazole, and the like.

Other examples of photostabilizer include 2,4'di-t-butylphenyl-3',5'-di-t-butyl-4'-hydroxybenzoate, nickel dibutyl-dithiocarbamate, and the like.

The charge transport layer is formed by applying a solution prepared by dissolving the charge transporting material and the binding resin disclosed above in an appropriate solvent, and drying the solution. Examples of the solvent used in the preparation of the coating liquid for charge transport layer formation include aromatic hydrocarbons such as benzene, toluene and chlorobenzene; ketones such as acetone and 2-butanone; halogenated aliphatic hydrocarbons such as methylene chloride, chloroform and ethylene chloride; cyclic or straight-chained ethers such as tetrahydrofuran, dioxane, ethylene glycol and diethyl ether; and the like, and these may be used as solvent mixtures as well.

The coating liquid for charge transport layer formation may also contain silicone oil as a leveling agent for improving the flatness and smoothness of the coating film formed by application of the coating liquid.

Application of the coating liquid for charge transport layer formation may be performed in accordance with the shape or use of the photoreceptor, using a coating method such as dip coating, ring coating, spray coating, bead coating, blade coating, roller coating, knife coating or curtain coating. Drying may be performed by tack-free drying at room temperature (for example, 25° C.), followed by heat drying. The heat drying may be carried out at a temperature range of 30° C. to 200° C., for a time period in the range of 5 minutes to 2 hours.

The thickness of the charge transport layer may be generally 5 μm to 50 μm, or may be 10 μm to 40 μm.

The charge generating layer may be formed by depositing a charge generating material by vacuum deposition, or may be formed by applying a solution containing a charge generating material as well as an organic solvent and a binding resin.

As for the charge generating material, selenium compounds such as amorphous selenium, crystalline selenium, selenium-tellurium alloys, selenium-arsenic alloys, and other selenium compounds; inorganic photoconductors such as selenium alloys, zinc oxide and titanium oxide; or products obtained by dye sensitizing these compounds; various phthalocyanine compounds such as metal-free phthalocyanine, titanyl phthalocyanine, copper phthalocyanine, tin phthalocyanine and gallium phthalocyanine; various organic pigments such as squalium pigments, anthoanthrone pigments, perylene pigments, azo pigments, anthraquinone pigments, pyrene pigments, pyrilium salts and thiapyrilium salts; or dyes may be used.

These organic pigments generally have various crystal types, and in particular, phthalocyanine compounds are known to have various crystal types, including α type, β type and the like. However, as long as the pigment is capable of achieving the aimed sensitivity and other properties, any of these crystal types may be used.

Among the charge generating materials described above, in the case of using a phthalocyanine compound, when the organic photosensitive layer is irradiated with light, the phthalocyanine compound contained in the organic photosensitive layer absorbs photons and generates carriers. Here, since phthalocyanine compounds have higher quantum efficiencies compared to other species, the phthalocyanine compounds efficiently absorb photons and generate carriers.

Further among the phthalocyanine compounds, phthalocyanines shown in the following (1) to (3) may be used.

(1) As a charge generating material, hydroxygallium phthalocyanine having diffraction peaks at least at the positions of 7.6°, 10.0°, 25.2° and 28.0°, at Bragg's angle (2θ±0.2°) in the X-ray diffraction spectrum obtained using CuKα radiation.

(2) As a charge generating material, chlorogallium phthalocyanine having diffraction peaks at least at the positions of 7.3°, 16.5°, 25.4° and 28.1°, at Bragg's angle (2θ±0.2°) in the X-ray diffraction spectrum obtained using CuKα radiation.

(3) As a charge generating material, titanyl phthalocyanine having diffraction peaks at least at the positions of 9.5°, 24.2° and 27.3°, at Bragg's angle (2θ±0.2°) in the X-ray diffraction spectrum obtained using CuKα radiation.

These phthalocyanine compounds have, in particular, higher photosensitivity as well as high stability of photosensitivity, compared to other species. Thus, a photoreceptor having an organic photosensitive layer containing such phthalocyanine compound may be suitable as a photoreceptor for color image forming apparatuses, from which high speed image formation and repeated reproducibility are required, as compared to other species.

In addition, there may be cases where the peak intensity or position of a material subtly deviates from the values given above owing to the shape of crystal or the method of measurement; however, if the X-ray diffraction patterns basically coincide, the material is judged to be of the same crystal type.

Examples of the binding resin used in the charge generating layer include the following: polycarbonate resins such as bisphenol A type or bisphenol Z type, and copolymers thereof; polyallylate resins, polyester resins, methacrylic resins, acrylic resins, polyvinyl chloride resins, polystyrene resins, polyvinyl acetate resins, styrene-butadiene copolymer resins, vinylidene chloride-acrylonitrile copolymer resins, vinyl chloride-vinyl acetate-maleic anhydride resins, silicone resins, silicone-alkyd resins, phenol-formaldehyde resins, styrene-alkyd resins, poly-N-vinylcarbazole, and the like.

These binding resins may be used individually or as mixtures of two or more species. The mixing ratio of the charge generating material and the binding resin (charge generating material: binding resin) may be in the range of 10:1 to 1:10 by weight. The thickness of the charge generating layer may be generally 0.01 μm to 5 μm, or may be 0.05 μm to 2.0 μm.

The charge generating layer may also contain at least one electron accepting material, for the purpose of improving the sensitivity, reducing the residual potential, and reducing fatigue upon repeated use. Examples of the electron accepting material used in the charge generating layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorene, picric acid, o-nitrobenzoic acid, p-nitrobenzoic acid, phthalic acid and the like. Among these, fluorenones, quinines or benzene derivatives having an electron withdrawing substituent such as Cl, CN or $NO_2$, may be used.

As for the method of dispersing the charge generating material in the resin, a method using a roll mill, a ball mill, a vibratory ball mill, an attriter, a Dyno mill, a sand mill, a colloid mill or the like, may be used.

As the solvent of the coating liquid for forming a charge generating layer, there may be mentioned known organic solvents, for example, aromatic hydrocarbon solvents such as toluene and chlorobenzene; aliphatic alcohol solvents such as methanol, ethanol, n-propanol, iso-propanol and n-butanol; ketone solvents such as acetone, cyclohexanone and 2-butanone; halogenated aliphatic hydrocarbon solvents such as methylene chloride, chloroform and ethylene chloride; cyclic or straight-chained ether solvents such as tetrahydrofuran, dioxane, ethylene glycol and diethyl ether; ester solvents such as methyl acetate, ethyl acetate and n-butyl acetate; and the like.

These solvents are used individually, or as mixtures of two or more species. When two or more solvents are used as a mixture, any solvent capable of dissolving the binding resin when used as a solvent mixture may be used. However, in the case where the organic photosensitive layer has a layer configuration having a charge transport layer 2B and a charge generating layer formed in this order from the conductive substrate side, if the charge generating layer is to be formed using a coating method that is likely to dissolve the underneath layer, such as dip coating, a solvent which is not likely to dissolve the underneath layer such as the charge transport layer may be used. Also, in the case where the charge generating layer is to be formed using spray coating or ring coating, in which method erosion of the underneath layer is relatively inhibited, the selection range of the solvent is broadened.

Next, the intermediate layer will be described. As for the intermediate layer, for example, a charge injection blocking layer may be formed between the surface layer and the charge generating layer, as necessary, in order to prevent the phenomenon that when the photoreceptor surface is charged by means of an electric charger, the electrical charges are injected from the photoreceptor surface to the conductive substrate of the photoreceptor, which is the electrode, so that charged potential cannot be obtained.

As for the material for the charge injection blocking layer, the above-listed silane coupling agents, titanium coupling agents, organozirconium compounds, organotitanium compounds, organometallic compounds other than those, and general-purpose resins such as polyesters and polyvinylbutyral, may be used. The thickness of the charge injection blocking layer is appropriately set to about 0.001 μm to 5 μm, with the film forming properties and carrier blocking properties being taken into consideration.

Process Cartridge and Image Forming Apparatus

Next, the process cartridge and image forming apparatus using the electrophotographic photoreceptor according to the present exemplary embodiment will be described by way of exemplary embodiments.

Figure 5:
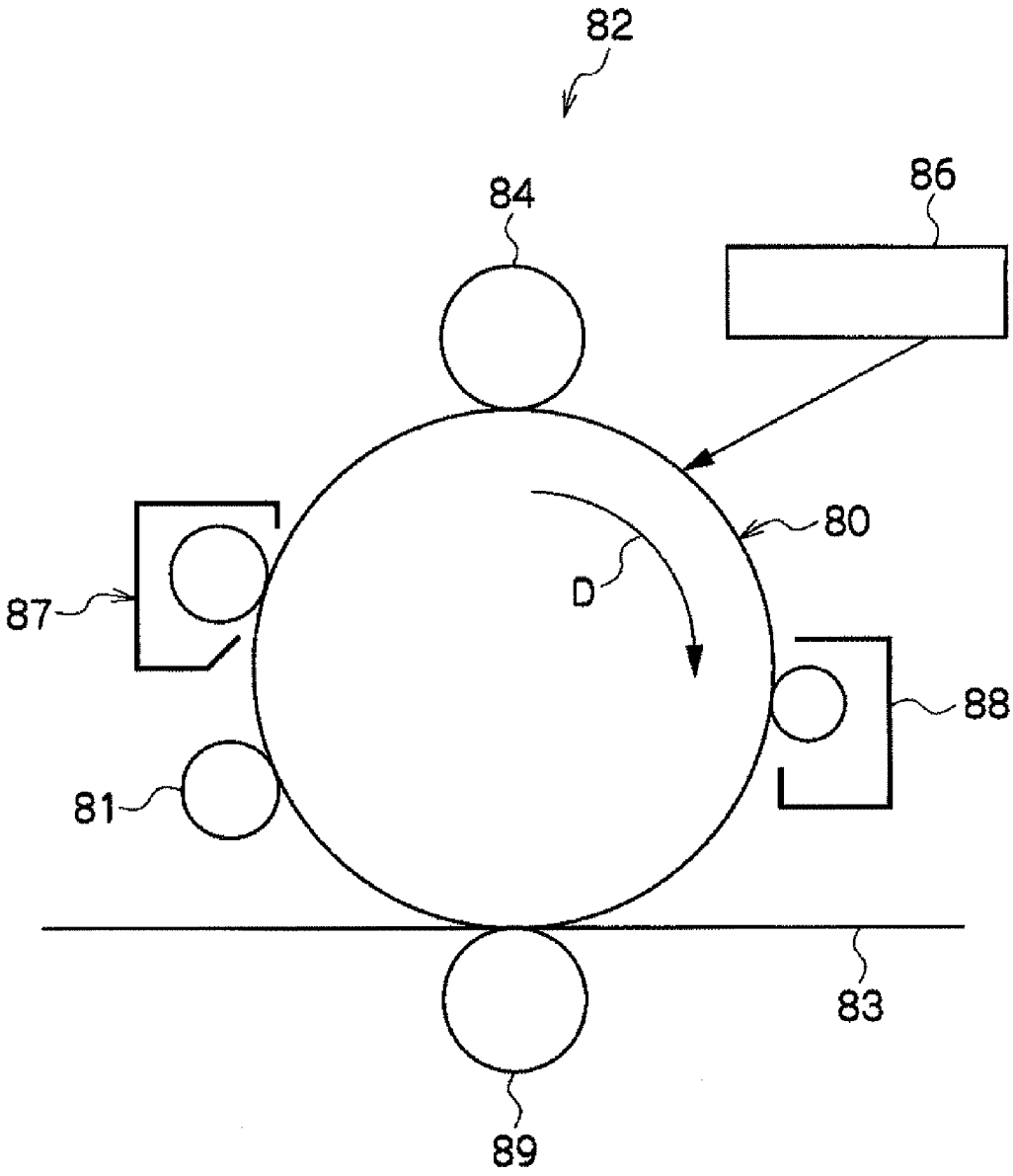
FIG. 5 is a schematic diagram showing an exemplary process cartridge and an exemplary image forming apparatus according to the present exemplary embodiment.

As shown in FIG. 5, the image forming apparatus 82 according to the present exemplary embodiment includes an electrophotographic photoreceptor 80 which rotates in a predetermined direction (direction of arrow D in FIG. 5). On the periphery of the electrophotographic photoreceptor 80, a charging unit (charging means) 84, an exposure unit (exposure means) 86, a development unit (development means) 88, a transfer unit (transfer means) 89, a charge removing unit 81, and a cleaning member 87 are provided along the rotation direction of the electrophotographic photoreceptor 80.

The charging unit 84 charges the surface of the electrophotographic photoreceptor 80 to a predetermined potential. The exposure unit 86 forms an electrostatic latent image in accordance with the image data, by exposing the surface of the electrophotographic photoreceptor 80 which has been charged by the charging unit 84. The development unit 88 stores in advance a developer containing a toner for developing the electrostatic latent image, and at the same time, supplies the stored developer to the surface of the electrophotographic photoreceptor 80, so as to develop the electrostatic latent image and form a toner image.

The transfer unit 89 transfers the toner image formed on the electrophotographic photoreceptor 80 onto a recording medium 83, by inserting and conveying the recording medium 83 through the gap between the transfer unit and the electrophotographic photoreceptor 80. The toner image transferred to the recording medium 83 is fixed on the surface of the recording medium 83 by a fixing unit, which is not shown in the drawing.

The charge removing unit 81 eliminates charges from the charged matters that are attached on the surface of the electrophotographic photoreceptor 80. The cleaning member 87 is installed so as to contact with the surface of the electrophotographic photoreceptor 80, and removes the attached matters on the surface by means of the frictional force against the surface of the electrophotographic photoreceptor 80.

The image forming apparatus 82 according to the present exemplary embodiment may be a so-called tandem machine, which has a plurality of the electrophotographic photoreceptor 80 corresponding to various colored toners. The transfer of the toner image to the recording medium 83 may be carried out by an intermediate transfer method in which the toner image formed on the surface of the electrophotographic photoreceptor 80 is first transferred to an intermediate transfer body and then transferred to a recording medium.

The process cartridge according to the present exemplary embodiment is provided to be attachable to and detachable from the main body of the image forming apparatus 82, and is constructed to have at least one selected from the group consisting of a charging unit 84, a development unit 88, a cleaning member 87 and a charge removing unit 81.

According to the present exemplary embodiment, the cleaning unit is not particularly limited, but may be a cleaning blade. The cleaning blade may be prone to damage the photoreceptor surface and accelerate abrasion, compared to other cleaning means.

However, since the process cartridge according to the present exemplary embodiment and the image forming apparatus 82 according to the present exemplary embodiment utilize the electrophotographic photoreceptor according to the present exemplary embodiment having a surface layer which suppresses the elevation of residual potential upon repeated use in the process of electrophotography, and has a hardness and a layer thickness sufficient to improve abrasion resistance, even in a long-term use, generation of damages or abrasion at the surface of the electrophotographic receptor is suppressed, and thus good images may be obtained.

EXAMPLES

Hereinafter, the invention will be described in more detail with reference to Examples, but the invention is not intended to be limited to these Examples.

Example 1

Fabrication of Electrophotographic Photoreceptor

—Formation of Undercoat Layer—

100 parts by weight of zinc oxide (average particle diameter: 70 nm, manufactured by Tayca Corp.) is mixed under stirring with 500 parts by weight of toluene, and 1.5 parts by weight of a silane coupling agent (trade name: KBM603, manufactured by Shin-Etsu Chemical Co., Ltd.) is added thereto. The mixture is stirred for 2 hours. Thereafter, toluene is distilled off by distillation under reduced pressure, and baking is performed for 2 hours at 150° C.

38 parts by weight of a solution prepared by dissolving 60 parts by weight of zinc oxide surface treated as above, 15 parts by weight of a curing agent (blocked isocyanate, trade name: SUMIJULE BL3175, manufactured by Sumitomo Bayer Urethane Co., Ltd.), and 15 parts by weight of a butyral resin (trade name: SLEC BM-1, manufactured by Sekisui Chemical Co., Ltd.) in 85 parts by weight of methyl ethyl ketone, is mixed with 25 parts by weight of methyl ethyl ketone to obtain a treatment liquid.

Subsequently, dispersion treatment is carried out according to the following procedure, using a horizontal media mill disperser (KDL-PILOT type, trade name: DYNO MILL, manufactured by Shinmaru Enterprises Corp.). The cylinder and stirring mill of the disperser are formed from ceramics containing zirconia as the main component. This cylinder is charged with glass beads having a diameter of 1 mm (trade name: HIBEA D20, manufactured by Ohara, Inc.) to a volume packing ratio of 80% by volume, and the dispersion treatment is carried out in a circulatory manner, at a rotating speed of the stirring mill of 8 m/min and at a flow rate of the treatment liquid of 1000 mL/min. The treatment liquid is transported using a magnet gear pump.

In the above dispersion treatment, after a lapse of a predetermined time period, a portion of the treatment liquid is sampled, and the transmittance at the time of film formation is measured. That is, the treatment liquid is applied on a glass plate to have a layer thickness of 20 μm, and curing treatment is performed at 150° C. for 2 hours to form a coating film. Then, the transmittance at a wavelength of 950 nm is determined using a spectrophotometer (trade name: U-2000, manufactured by Hitachi, Ltd.). At the time point where this transmittance (value for a layer thickness of 20 nm) exceeds 70%, the dispersion treatment is finished.

To the dispersion liquid thus obtained, 0.005 parts by weight of dioctyltin dilaurate as a catalyst and 0.01 parts by weight of silicone oil (trade name: SH29PA, manufactured by Toray Dow Corning Silicone Co., Ltd.) are added to prepare a coating liquid for undercoat layer. This coating liquid is applied onto an aluminum substrate having a diameter of 84 mm, a length of 340 mm and a thickness of 1 mm by a dip coating method, and dry curing is performed at 160° C. for 100 minutes, to form an undercoat layer having a layer thickness of 20 μm.

—Formation of Organic Photosensitive Layer—

An organic photosensitive layer consisting of a charge generating layer and a charge transport layer is formed on the undercoat layer as follows. First, a mixture including 15 parts by weight of chlorogallium phthalocyanine having diffraction peaks at least at the positions of 7.4°, 16.6°, 25.5° and 28.3° at Bragg's angle (2θ±0.2°) in the X-ray diffraction spectrum obtained using CuKα radiation, as a charge generating material, 10 parts by weight of a vinyl chloride-vinyl acetate copolymer resin (trade name: VMCH, manufactured by Nippon Unicar Co., Ltd.) as a binding resin, and 300 parts by weight of n-butyl alcohol, is subjected to dispersion treatment for 4 hours with a sand mill using glass beads having a diameter of 1 mm, to obtain a coating liquid for charge generating layer. The obtained dispersion is applied on the undercoat layer by dip coating, and dried to form a charge generating layer having a layer thickness of 0.2 μm.

4 parts by weight of N,N'-diphenyl-N,N'-bis(3-methylphenyl)-[1,1']biphenyl-4,4'-diamine and 6 parts by weight of a bisphenol Z polycarbonate resin (viscosity average molecular weight: 40,000) are added to 80 parts by weight of chlorobenzene and dissolved therein, to obtain a coating liquid for charge transport layer. This coating liquid is applied on the charge generating layer, and dried at 130° C. for 40 minutes, to form a charge transport layer having a layer thickness of 25 μm. Thus, an organic photoreceptor (non-coated photoreceptor) is obtained. In this organic photoreceptor, the dynamic hardness of the organic photosensitive layer (including the undercoat layer) is 7.1 GPa.

—Formation of Surface Layer—

Subsequently, a surface layer is formed on the non-coated photoreceptor by plasma CVD. A Si substrate (5 mm×10 mm) for the fabrication of a reference sample is attached to the non-coated photoreceptor with adhesive tape, and the assembly is introduced into a plasma CVD apparatus as shown in FIG. 4. The interior of the vacuum chamber 32 is vacuum exhausted until the pressure reaches $1\times10^{-2}$ Pa. Then, hydrogen gas at a flow rate of 100 sccm, He-diluted oxygen (4%) at a flow rate of 4 sccm, and hydrogen-diluted trimethylgallium (about 10%) at a flow rate of 4 sccm are supplied to the vacuum chamber 32 from gas supply pipes through a mass flow controller 36, and at the same time, the conductance valve is controlled to adjust the pressure inside the vacuum chamber 32 to 10 Pa. Discharge from a discharge electrode 54 is carried out while a radio wave at 13.56 MHz is set to an output power of 80 W by means of a high frequency power supply 58 and a matching box 56, matching is carried out using a tuner, and the reflected wave is set at 0 W. Under these conditions, while the non-coated photoreceptor is rotated at a rotating speed of 40 rpm, film forming is conducted for 60 minutes to obtain a photoreceptor 1 with a surface layer. The supply of this hydrogen-diluted trimethylgallium gas is achieved by bubbling hydrogen as a carrier gas into trimethylgallium maintained at 0° C. The obtained photoreceptor is left to stand still in an environment at 20° C. for 24 hours.

—Analysis and Evaluation of Surface Layer—

The reference sample formed on the Si substrate is cleaved, and the cleaved cross-section is observed under a scanning electron microscope (SEM) to measure the layer thickness. Thus, the results shown in Table 2 are obtained.

An analysis of the composition of the film formed on the Si reference sample is carried out by Rutherford back scattering (RBS) and hydrogen forward scattering (HFS), and the compositions of Ga, O, H and C are obtained as shown in Table 2.

—Measurement of Microhardness of Surface Layer—

For the reference sample formed on the Si substrate, the microhardness of the surface layer is measured by a continuous stiffness measurement method, using an ultramicrohardness meter (trade name: NANO INDENTER DCM, manufactured by MTS Systems Corp.). A regular triangular pyramid indenter made of diamond (Berkovich indenter) is used as the indenter. The measurement conditions are established to provide a measurement environment at 20° C. and at 50% humidity. The hardness value is obtained from the obtained hardness profile at an indentation depth of 40 nm. The results are shown in Table 2.

—Potential Characteristics—

An evaluation is performed on the potential characteristics of the electrophotographic photoreceptor having a surface layer formed thereon. First, with regard to each of the above-described non-coated photoreceptor before the formation of surface layer and the electrophotographic photoreceptor having a surface layer formed thereon, scanning irradiation of exposure light (light source: semiconductor laser, wavelength: 780 nm, output power: 5 mW) is carried out to the surface of the photoreceptor which is charged to −700 V by a scorotron charger and is being rotated at 40 rpm.

Thereafter, the potential status (residual potential) of the photoreceptor is investigated by measuring the potential of the photoreceptor using a surface potentiometer (Model 344, manufactured by Trek Japan Co., Ltd.), and using a probe having a measurement area width of 10 mm (Model 555P-1, manufactured by Trek Japan Co., Ltd.), while the photoreceptor is scanned in the direction of the drum axis and in the direction of rotation, with the probe being disposed at a distance of 2 nm from the photoreceptor, to thereby carrying out mapping. As a result, while the potential of the non-coated photoreceptor is −20 V, the residual potential of the photoreceptor provided with a surface layer is as shown in Table 2.

Furthermore, charging and exposure are repeated 100 times under the conditions as described above, and the residual potentials of the non-coated photoreceptor and the photoreceptor provided with a surface layer are measured in the same manner As a result, while the potential of the non-coated photoreceptor is −22 V, the potential of the photoreceptor provided with a surface layer exhibits the values shown in Table 2.

—Evaluation of Electrophotographic Photoreceptor—

The electrophotographic photoreceptor having a surface layer formed thereon is mounted on a process cartridge for DocuCentre Colar 500 manufactured by Fuji Xerox Co., Ltd., and the process cartridge is installed in DocuCentre Colar 500, to perform a printing test. The printing test is performed in a high temperature and high humidity environment at an air temperature of 28° C. and humidity of 85%.

Figure 6:
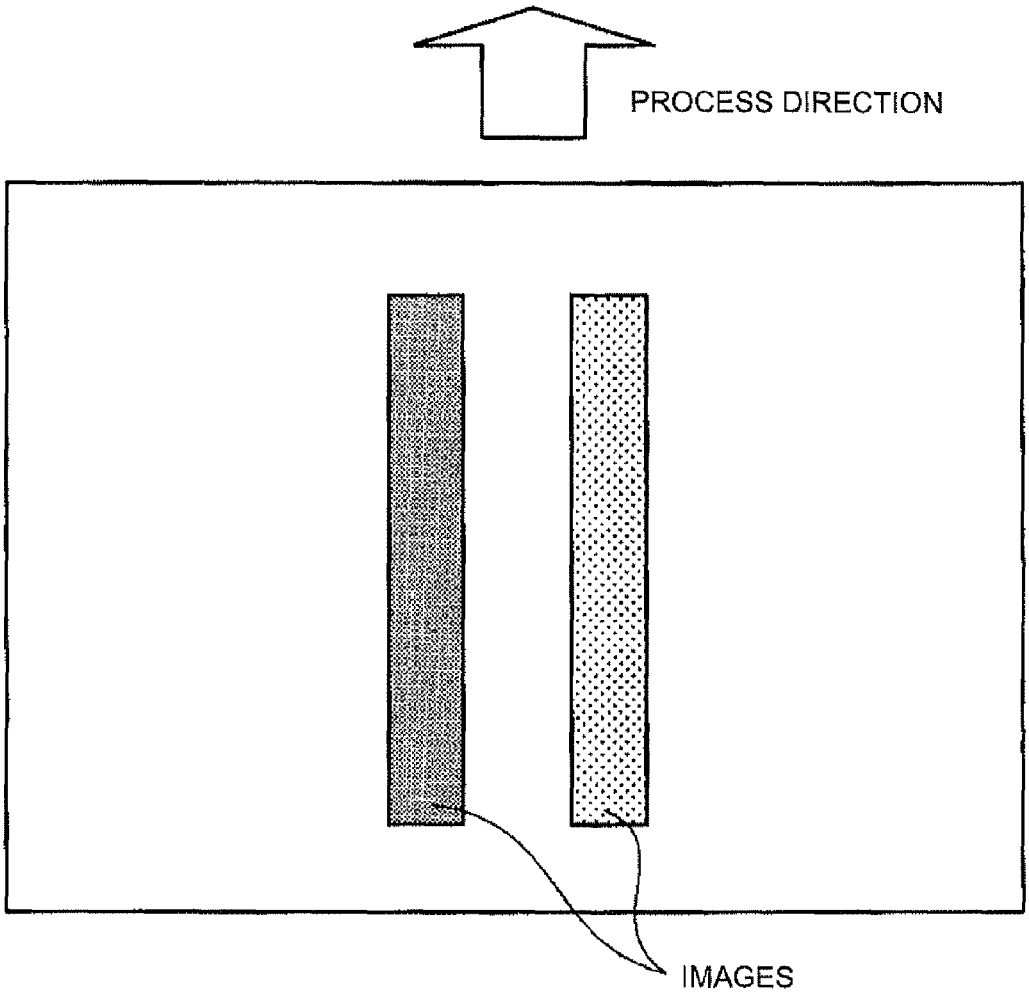
FIG. 6 is a schematic diagram illustrating the outputting of images with different amounts of development performed in the evaluation of an electrophotographic photoreceptor in an Example.

First, as shown in FIG. 6, 50,000 sheets of a run chart of A4 size having two image sections with different development amounts (development amount of one image: area coverage ratio 100%, development amount of the other image: area coverage ratio 50%) are printed. The two images with different development amounts are each rectangular in shape, with the longitudinal direction being along the process direction (direction of paper conveyance), and the images are formed to be arranged in the direction orthogonal to the process direction.

Then, the "halftone density unevenness" is evaluated with a halftone image of full A3 size at 200 dpi (dots per inch) and an area coverage ratio of 50%, and the "streak-like image deletion" is evaluated with an image of line-and-space (horizontal ladder), in which line images of 0.2 mm in width are formed at an interval of 0.2 mm in the direction perpendicular to the process direction. Then, the power supply is turned off, left to stand for 12 hours, and then is turned on, and simultaneously with the turn-on, 100 sheets of a halftone image of full A3 size at 200 dpi and an area coverage ratio of 50% are printed. Thus, the "characteristics of recovery from a decrease in density after stopping" is evaluated. The evaluation criteria are as follows.

Halftone Density Unevenness

A: The image density is uniform over the whole surface, and the difference is hardly recognized by naked eyes. If any difference exists, the difference is not due to the image density of the run chart.

B: It is recognized by naked eyes that the image density at the position corresponding to the image section of 100% coverage in the run chart is slightly higher or lower than that at the other position.

C: It is recognized by naked eyes that the image density at the position corresponding to the image section of 100% coverage in the run chart is higher or lower than that at the other position. Furthermore, it is recognized by naked eyes that the image density at the position corresponding to the image section of 50% coverage is slightly higher or lower than that at the other position.

Streak-Like Image Deletion

A: A horizontal ladder is normally formed.

B: Streak-like image deletion is generated, and thus abnormality in the horizontal ladder is recognized.

Characteristics of Recovery From Decrease in density After Stopping

A: No decrease in the image density is recognized in the first image after the power-on.

B: A decrease in the image density is recognized in the first image after the power-on, but no decrease in the density is recognized in the $10^{th}$ image after the power-on.

C: A decrease in the image density is recognized in the $1000^{th}$ image after the power-on.

The evaluation results are presented in Table 2, together with the specifications of the obtained electrophotographic photoreceptor.

Example 2 to Example 9

Comparative Example 1 to Comparative Example 3

Photoreceptors 2 to 9 provided with surface layers, and comparative photoreceptors 1 to 3 are obtained in the same manner as in Example 1, except that the conditions for surface layer formation (radio wave output power, flow rate of He-diluted trimethylgallium, flow rate of He-diluted oxygen (4%), growth time) in the fabrication of the electrophotographic photoreceptor in Example 1 are changed to the conditions indicated in Table 1. An analysis of the surface layer, and an evaluation of hardness and electrical properties are performed in the same manner as in Example 1, using the Si reference sample. An evaluation of the electrophotographic characteristics is performed in the same manner as in Example 1, using the photoreceptors. The results are summarized and presented in Table 2.

TABLE 1

| Conditions for surface layer formation | | | | | |
|---|---|---|---|---|---|
| | Photoreceptor No | Radio wave output power (W) | Flow rate of TMGa (sccm) | Flow rate of $O_2$ (sccm) | Growth time (min) |
| Example 1 | Photoreceptor 1 | 80 | 4 | 4 | 60 |
| Example 2 | Photoreceptor 2 | 80 | 4 | 4 | 400 |
| Example 3 | Photoreceptor 3 | 125 | 4 | 5 | 150 |
| Example 4 | Photoreceptor 4 | 200 | 4 | 10 | 72 |
| Example 5 | Photoreceptor 5 | 200 | 4 | 10 | 500 |
| Example 6 | Photoreceptor 6 | 125 | 4 | 3.5 | 65 |
| Example 7 | Photoreceptor 7 | 125 | 4 | 3.5 | 215 |
| Example 8 | Photoreceptor 8 | 125 | 4 | 7.5 | 55 |
| Example 9 | Photoreceptor 9 | 125 | 4 | 7.5 | 170 |
| Comparative Example 1 | Comparative Photoreceptor 1 | 80 | 5 | 4 | 120 |
| Comparative Example 2 | Comparative Photoreceptor 2 | 250 | 4 | 10 | 600 |
| Comparative Example 3 | Comparative Photoreceptor 3 | 125 | 4 | 5 | 54 |

From the above results, it is understood that the Examples of the invention may provide images in which the electrical properties (residual potential), characteristics of recovery after stopping, density unevenness and streak-like image deletion are prevented, and thus image defects is prevented, as compared to the Comparative Examples.

What is claimed is:

1. An electrophotographic photoreceptor comprising an electrically conductive substrate, an organic photosensitive layer and a surface layer laminated in this order, the surface layer comprising at least gallium (Ga), oxygen (O), and hydrogen (H) as constituent elements thereof, and having a thickness of 0.2 μm to 1.5 μm, and a microhardness of 2 GPa to 15 GPa wherein in the surface layer, the sum of the respective elemental composition ratios of gallium (Ga) and oxygen (O) to all the elements constituting the surface layer is 0.70 or more, and the elemental composition ratio of oxygen (O) to gallium (Ga) (oxygen/gallium) is from 1.1 to 1.5.

TABLE 2

| Evaluation results | | | | | | | | | | |
|---|---|---|---|---|---|---|---|---|---|---|
| | Photoreceptor | Elemental composition (atomic %) | | | | Sum of elemental composition ratios | | Elemental composition ratio | Micro-hardness | Layer thickness |
| | No | Ga | O | H | C | Ga and O | Ga and O and H | [O]/[Ga] | (GPa) | (μm) |
| Example 1 | Photoreceptor 1 | 35 | 39 | 22 | 4 | 0.74 | 0.96 | 1.11 | 2.1 | 0.21 |
| Example 2 | Photoreceptor 2 | 35 | 39 | 22 | 4 | 0.74 | 0.96 | 1.11 | 2.3 | 1.43 |
| Example 3 | Photoreceptor 3 | 36 | 44 | 20 | 0 | 0.80 | 1.00 | 1.22 | 7.1 | 0.5 |
| Example 4 | Photoreceptor 4 | 37 | 55 | 8 | 0 | 0.92 | 1.00 | 1.49 | 14.1 | 0.21 |
| Example 5 | Photoreceptor 5 | 37 | 55 | 8 | 0 | 0.92 | 1.00 | 1.49 | 14.1 | 1.46 |
| Example 6 | Photoreceptor 6 | 37 | 43 | 20 | 0 | 0.80 | 1.00 | 1.16 | 4.3 | 0.21 |
| Example 7 | Photoreceptor 7 | 37 | 43 | 20 | 0 | 0.80 | 1.00 | 1.16 | 4.2 | 0.69 |
| Example 8 | Photoreceptor 8 | 36 | 48 | 16 | 0 | 0.84 | 1.00 | 1.33 | 9.1 | 0.22 |
| Example 9 | Photoreceptor 9 | 36 | 48 | 16 | 0 | 0.84 | 1.00 | 1.33 | 9.1 | 0.69 |
| Comparative Example 1 | Comparative photoreceptor 1 | 33 | 36 | 25 | 6 | 0.69 | 0.94 | 1.09 | 1.8 | 0.51 |
| Comparative Example 2 | Comparative photoreceptor 2 | 38 | 56 | 6 | 0 | 0.94 | 1.00 | 1.47 | 15.2 | 1.6 |
| Comparative Example 3 | Comparative photoreceptor 3 | 36 | 44 | 20 | 0 | 0.80 | 1.00 | 1.22 | 7.1 | 0.18 |

| | Characteristics of recovery after stopping | Halftone density unevenness | Streak-like image deletion | Initial residual potential (V) | Residual potential after repeated use (V) |
|---|---|---|---|---|---|
| Example 1 | A | B | A | −25 | −26 |
| Example 2 | A | B | A | −33 | −40 |
| Example 3 | A | A | A | −28 | −35 |
| Example 4 | B | A | A | −28 | −78 |
| Example 5 | B | A | A | −37 | −110 |
| Example 6 | A | A | A | −25 | −26 |
| Example 7 | A | A | A | −28 | −30 |
| Example 8 | A | A | A | −32 | −42 |
| Example 9 | A | A | A | −34 | −48 |
| Comparative Example 1 | A | C | A | −28 | −30 |
| Comparative Example 2 | C | A | A | −40 | −117 |
| Comparative Example 3 | A | A | B | −25 | −27 |

2. The electrophotographic photoreceptor according to claim 1, wherein the surface layer has a thickness of 0.2 μm to 0.7 μm.

3. The electrophotographic photoreceptor according to claim 2, wherein the surface layer has a microhardness of 4 GPa to 10 GPa.

4. The electrophotographic photoreceptor according to claim 1, wherein in the surface layer, the sum of the respective elemental composition ratios of gallium (Ga), oxygen (O) and hydrogen (H) to all the elements constituting the surface layer is 0.95 or more; and the elemental composition ratio of oxygen (O) to gallium (Ga) (oxygen/gallium) is from 1.1 to 1.4.

5. The electrophotographic photoreceptor according to claim 4, wherein in the surface layer, the sum of the respective elemental composition ratios of gallium, oxygen and hydrogen to all the elements constituting the surface layer is 0.99 or more.

6. The electrophotographic photoreceptor according to claim 1, wherein the content of hydrogen in the surface layer is 1 atomic % to 30 atomic %.

7. The electrophotographic photoreceptor according to claim 1, wherein the content of hydrogen in the surface layer is 5 atomic % to 20 atomic %.

8. An electrophotographic photoreceptor comprising an electrically conductive substrate, an organic photosensitive layer and a surface layer laminated in this order, the organic photosensitive layer having a dynamic hardness of 0.1 GPa to 10 GPa, and the surface layer comprising at least gallium (Ga), oxygen (O), and hydrogen (H) as constituent elements thereof, and having a thickness of 0.2 μm to 1.5 μm, and a microhardness of 2 GPa to 15 GPa, wherein in the surface layer, the sum of the respective elemental composition ratios of gallium (Ga) and oxygen (O) to all the elements constituting the surface layer is 0.70 or more, and the elemental composition ratio of oxygen (O) to gallium (Ga) (oxygen/gallium) is from 1.1 to 1.5.

9. A process cartridge that is attachable to and detachable from the main body of an image forming apparatus, the process cartridge comprising:

the electrophotographic photoreceptor according to claim 1; and at least one selected from the group consisting of a charging unit that charges a surface of the electrophotographic photoreceptor, a development unit that develops an electrostatic latent image formed on the surface of the electrophotographic photoreceptor into a toner image with a developer, and a transfer unit that transfers the toner image onto a recording medium.

10. A process cartridge that is attachable to and detachable from the main body of an image forming apparatus, the process cartridge comprising:

the electrophotographic photoreceptor according to claim 8; and at least one selected from the group consisting of a charging unit that charges a surface of the electrophotographic photoreceptor, a development unit that develops an electrostatic latent image formed on the surface of the electrophotographic photoreceptor into a toner image with a developer, and a transfer unit that transfers the toner image onto a recording medium.

11. An image forming apparatus comprising:

the electrophotographic photoreceptor according to claim 1;

a charging unit that charges a surface of the electrophotographic photoreceptor;

an exposure unit that exposes the surface of the electrophotographic photoreceptor charged by the charging unit to form an electrostatic latent image;

a development unit that develops the electrostatic latent image with a developer containing at least a toner, to form a toner image; and a transfer unit that transfers the toner image onto a recording medium.

12. An image forming apparatus comprising:

the electrophotographic photoreceptor according to claim 8;

a charging unit that charges a surface of the electrophotographic photoreceptor;

an exposure unit that exposes the surface of the electrophotographic photoreceptor charged by the charging unit to form an electrostatic latent image;

a development unit that develops the electrostatic latent image with a developer containing at least a toner, to form a toner image; and a transfer unit that transfers the toner image onto a recording medium.

* * * * *